US006257190B1

(12) United States Patent
Linebarger

(10) Patent No.: US 6,257,190 B1
(45) Date of Patent: Jul. 10, 2001

(54) CAM OPERATING SYSTEM

(76) Inventor: Terry Glyn Linebarger, 901 Thornridge Cir., Argyle, TX (US) 76226

( * ) Notice: Subject to any disclaimer, the term of this patent is extended or adjusted under 35 U.S.C. 154(b) by 0 days.

(21) Appl. No.: 09/556,851

(22) Filed: Apr. 21, 2000

Related U.S. Application Data

(62) Division of application No. 09/143,681, filed on Aug. 28, 1998, now Pat. No. 6,053,134.

(51) Int. Cl.[7] ..... F01L 3/02
(52) U.S. Cl. ..... 123/188.3; 29/888.4
(58) Field of Search ..... 123/90.15, 90.16, 123/90.2, 90.24, 90.25, 90.26, 90.39, 90.44, 90.6, 188.1, 188.4, 188.2, 188.3, 188.8; 29/888.4, 888.45, 888.46

(56) References Cited

U.S. PATENT DOCUMENTS

| | | | | |
|---|---|---|---|---|
| 1,671,973 | * | 6/1928 | Anderson | 123/90.25 |
| 2,627,259 | * | 2/1953 | Wood | 123/188.3 |
| 2,832,327 | * | 4/1958 | Lorenz | 123/90.24 |
| 3,040,417 | * | 6/1962 | Newton | 29/888.452 |
| 4,901,684 | * | 2/1990 | Wride | 123/90.16 |
| 5,056,219 | * | 10/1991 | Iwase | 29/888.451 |
| 5,056,476 | * | 10/1991 | King | 123/90.16 |
| 5,245,957 | * | 9/1993 | Bornstein et al. | 123/90.26 |
| 5,370,092 | * | 12/1994 | Shimizu et al. | 123/188.3 |
| 5,370,364 | * | 12/1994 | Kenmoku et al. | 251/368 |
| 5,413,073 | * | 5/1995 | Larson et al. | 123/188.3 |
| 5,441,024 | * | 8/1995 | Wietig et al. | 123/188.3 |
| 5,458,314 | * | 10/1995 | Bonsteel | 251/337 |
| 5,662,745 | * | 9/1997 | Takayama et al. | 148/237 |
| 6,009,843 | * | 1/2000 | Griffin et al. | 123/188.3 |

* cited by examiner

*Primary Examiner*—Wellun Lo
(74) *Attorney, Agent, or Firm*—Howrey Simon Arnold & White, LLP

(57) ABSTRACT

A cam system to generate valve actuation in an engine that includes a circular camlobe rotated about a first axis is described. The first axis is a preselected distance from the centerpoint of the circular camlobe. The cam system also includes a cam-follower that surrounds the camlobe and that has an inner oval surface with a major and minor axis. The inner oval surface is in moving contact with the circular camlobe during rotation of the camlobe.

4 Claims, 19 Drawing Sheets

CAM OPERATING SYSTEM

This is a divisional of application Ser. No. 09/143,681 filed Aug. 28, 1998 now U.S. Pat. No. 6,053,134.

BACKGROUND OF THE INVENTION

1. Field of the Invention

The invention relates in general to the field of engines, particularly to gasoline-type internal combustion engines, although it is also applicable to air compressors, gas, and diesel cycle engines. More specifically, the invention relates to cam systems used with internal combustion engines to vary the actuation, timing, duration, lift, and operation of valves.

2. Background and Description of the Related Art

An internal combustion engine burns fuel within one or more cylinders and converts the expansive force of combustion into a motive power able to do work. In an internal combustion engine for a vehicle (such an automobile or motorcycle), this process involves converting the combustion force into rotational force on the crankshaft which is then transferred to move the vehicle.

Each cylinder of an internal combustion engine contains a reciprocating piston. The piston is contained within the cylinder in a tight-fit sliding arrangement that permits only a linear reciprocating motion. In a typical four-stroke engine, the piston requires four movements (strokes) for each complete power cycle, each stroke lasting 180 degrees or one-half of a crankshaft revolution. The first stroke is the intake cycle, in which the piston moves downward from approximately its top dead center position. This creates a vacuum within the cylinder, and outside atmospheric pressure forces a gaseous air-fuel mixture into the cylinder. The second stroke, or compression cycle, is an upward movement of the piston from approximately bottom dead center position to compress the air-fuel mixture in the cylinder. Combustion takes place during the start of the third stroke. The air-fuel mixture is ignited, such as through a spark plug, and the expansive/explosive force of the ignited gases pushes the piston downward. This third stroke is also called the power stroke, and it is the resultant force that is transmitted to whatever workload is being driven by the engine, such as the power output drive shaft of a vehicle. The fourth stroke, or the exhaust cycle, occurs during an upward movement of the piston to force the burned gases out of the cylinder. This also prepares the cylinder for the start of a new complete cycle.

An important aspect of the four-stroke internal combustion engine is a series of valves that open and close a plurality of valve actuated fluid ports to allow the flow of fuel-air mixture into the cylinder during the intake stroke, and allow the burned gases to be removed from the cylinder during the exhaust stroke, but provide air-tight seals during the compression and combustion strokes. The timing of the opening and closing of these valves is critical to the engine's function. Each cylinder contains one or more intake valves, and one or more exhaust valves.

Generally, these valves are opened by a camshaft or camshafts containing a number of conventional camlobes. Camlobes are non-circular shapes (the most common is egg-shaped) that act on the valve causing it to move. Camlobes may transmit force directly to the valve stem, or indirectly through lifters, rocker arms, pushrods or other valve actuating components. For example, in a direct acting system the camlobe may be coupled to a valve stem by bucket tappets, or other suitable coupling members or linkages to cause the valve to open during a certain period of camshaft rotation when the shape of the camlobe causes the valve stem to move (a translational force). When the camshaft has rotated sufficiently to remove the force of the camlobe on the valve stem, valve springs are typically used to return the valve to a closed position. Alternatively, in a positive open and closing system, such as the desmodromic type system currently used in certain motorcycle applications, separate camlobes may be used both for opening or closing the individual valves.

During the exhaust stroke but before the piston reaches bottom dead center, when most of the air-fuel mixture has been burned, the exhaust valve opens and the pressure in the cylinder begins to push the exhaust gases out. The piston then begins its upward movement, forcing the remainder of the spent fuel-air mixture out. While the piston is moving upward, the exhaust valve goes through its maximum lift position and begins to close. The period a valve is open is known as the duration of the valve lift.

Moving toward the intake stroke, the intake valve begins to open before the exhaust valve is completely closed, and before the piston reaches the top dead center position. This period in which both intake and exhaust valves are open is called overlap. The timing of valve opening and closing, and amounts of lift, duration, and overlap are critical elements in design of cams, camshafts, and other valve actuating components.

One problem that has plagued the internal combustion engine is designing a cam system that provides a combination of efficiency and performance across a wide range of engine speeds. For example, at low engine speeds, where increased torque is desired, the intake valves are opened later allowing the cylinders to fill with air-fuel mixture very effectively. In this case, little or no overlap is desired, since overlap may allow unburned fuel to flow out through the exhaust port (increasing emissions) and burned exhaust gases to mingle with the intake flow. This is remedied at lower engine speeds by early exhaust closing.

Conversely, at higher engine speeds, where maximum horsepower is desired, the intake cycle begins earlier to take advantage of charge inertia and closes later with some charge reversion. On extended overlap (with a later closing exhaust) this earlier intake cycle leads to some charge loss, a portion of the air-fuel charge going out the closing exhaust port opened during the end of the combustion cycle.

The overall intake and exhaust cycles are longer with the timing occurring for earlier opening points and later closing points, though the actual effective timing is shorter due to charge loss, dilution, and reversion. The mean volume of trapped charge is greater than the efficient low engine speed timing marks. In this case, an earlier and longer timing and duration with long overlap is desired. If the intake valve is not opened earlier and closed later, a smaller volume of fuel-air mixture will be introduced into the cylinder hindering engine performance at higher engine speeds. Thus, the amounts of overlap are a critical part of the engine's performance.

When most of the exhaust gases are pushed out by the piston's upward movement during the exhaust stroke, the intake valve begins to open, overlapping with the open time of the exhaust valve. The inertia of the exhaust gases continues the flow through the exhaust port, and provides an initial draw for the start of the intake flow. Generally, because of the need to overcome inertia in the air column outside the intake port, the early portion of the intake valve opening period does not provide much flow of the air-fuel mixture. This is also true because the valve accelerates more slowly at the beginning and end of each opening and closing cycle, to reduce high impact wear on the valve and valve seat (and noise) from rapid sealing contact, all of which is an inherent design compromise with conventional camlobe systems.

When the piston passes up to top dead center and begins its downward stroke, the intake valve opens to its maximum lift allowing the greatest possible volume of the fuel-air mixture to flow into the cylinder. The dwell period of the cam rotation in which the valve remains open is also known as the duration, and is generally defined in terms of dwell degrees of crank-shaft rotation. The intake valve closes, usually slightly after reaching bottom dead center, so that cylinder pressure can be developed during the compression stroke of the piston. Here valve timing is important because the valve needs to be open long enough for a large capacity charge of fuel-air mixture to fill the cylinder, but must close soon enough, and quickly enough, to allow maximum cylinder pressure to develop through charge trapping.

As can be seen, there are several critical parts of the engine cycle affected by the design of the cam system. The amount of overlap, and the timing of valve opening and closing, are critical parts of the engine cycle, and are best varied with the rotational speed of the engine. The amounts of valve lift and duration, are also important considerations for maximizing the overall dynamic performance envelope.

In the traditional egg-shaped camlobe valve actuating system, the system has been designed for a compromise between low and high speed engine performance. Recently, there have been attempts to develop a variable valve timing system based on the redesign and adaptation of the traditional egg-shaped cam system. Typically these attempts have involved creating a system where the cam operation can be controlled by rotationally advancing and retarding the cam shaft in relation to its drive system or gear. This results in a change in the initial valve timing, since the camlobes will now rotate into their opening and closing positions at different locations during each complete cycle of the crankshaft. Advancing the camshaft does not affect lift or duration, only the initial timing of valve opening and closing relative to the crankshaft position. These systems typically have two positions-the cam shaft is either in its normal position (for low speed) or is advanced (for high speed), thus the valve timing is not truly variable except for a choice between two predetermined settings.

Another example of attempts to develop a variable valve timing system can be seen in those cam combinations that employ a plurality of stacked cam shaft lobes of varying shape. One lobe may be shaped for smooth low speed operating conditions, providing short duration and little overlap. Another lobe (or pair of lobes) may be adapted to provide long overlap and duration, and/or increased lift, at high engine speeds. The lobe which is operating on a given valve may be replaced by changing the position or configuration of multiple rocker arms through the use of control linking servo pistons. While this solution also provides two operating conditions, it is again not truly variable in that one of the two cam profiles is chosen for control and there are no in-between parameters. In addition, this solution adds the dynamic mass, weight, and rotational friction of additional rocker arms and cam lobes to the engine's valve actuating system, requiring greater valve opening and closing forces to overcome the greater friction inertias and thereby reducing overall engine efficiency and output horsepower.

Another area that has troubled cam system designers is the structural design of the valve and its ability to withstand the fatigue-stress forces induced by the valve's inertial mass and its reciprocating action. In relation to valve timing and the concurrent rate of change of velocity, the reason this is a concern is simple; in order to overcome the inertia of the air column in the intake stroke, it is desirable to have the valve reach its full open position as quickly as possible. However, the faster the valve is opened, the greater the force and stress introduced into the valve stem, throat, tip and valve keeper (connection between the valve stem/tip and the rocker arm or other force-transfer mechanism). Similarly, it may be desirable to close the valve as quickly as possible, either to optimize intake charge trapping to allow maximum compression as the piston begins its up stroke or to provide the longest possible valve overlap. Valve stresses, as well as the terminal speed and impact force of the valve as it contacts the valve seat, are then causes for additional concern, since in either case the valve has a limit to the severity of the stresses it can withstand without fatigue damage, or excessive wear. Moreover, this problem is complicated in that the valve system preferably has low dynamic mass weight.

SUMMARY OF THE INVENTION

The invention relates to a cam system to more effectively control valve actuation, operation, and function in an internal combustion engine. The system includes one or more circular camlobes driven by one or more camshafts that rotate about a first axis. The first axis is a preselected distance from the center-point of a circular camlobe, resulting in an eccentric rotation. The degree of eccentricity is selected as a function of the desired resultant valve lift.

Each cam system includes a cam-follower that has an inner circumferential surface with a major and minor axis defining a generally elliptical or ovoid shape. This general type of follower may sometimes be referred to as a yoke follower.

Some portions of the cam-follower's inner surface are in contact with the circular camlobe throughout the rotational period, preferably two point contact at the minor axis and large contact area at the major axis. During one complete revolution of the camlobe as traced upon the inner circumference of the cam-follower, there occur four distinct valve actuating phases. These valve actuating phases are typified by their being in a state of rest or movement. The valve is at rest twice during the camlobe's revolution: first, when the valve is fully closed, and second, when the valve is fully opened. These phases correspond to the camlobe tracing the cam-follower in the vicinity of the cam-follower's minor axis where upon the camlobe assumes a two-point contact coupling, thus reducing unnecessary contact surface friction during these static valve states. As the valve goes through the movement phases of opening and closing, the camlobe moves into the proximity of the major axis of the cam-follower and therefore necessitating a large contact surface at the point of contour coupling where the forces of opening and closing can be efficiently transferred.

This configuration is especially beneficial for positive open and close valve systems such as the desmodromic system. The interaction of the eccentrically rotated circular camlobe and the elliptical or ovoid inner surface of the cam-follower combines to create the basis for a novel valve actuation system with improved opening and closing characteristics, and a high degree of functional adjustability over a wide range of engine speeds and conditions.

Choosing or designing the shape of the elliptical or ovoid inner surface may be varied to result in longer or shorter valve open and/or closed dwell periods, or to retain the valves in a full-open or full-closed position for a longer dwell time. In addition, the cam-follower may be partially rotated bi-directionally during operation to advance or retard the timing of valve opening and/or closing. The cam-follower's rotatability is dynamic, and is not limited to two positions but may be adjustably controlled and varied over the entire range of engine operation and performance. The cam-follower typically comprises part of an output linkage which couples the camlobe to a valve or its valve stem. Thus, the linkage may also comprise a rocker arm, a push rod, a lever or other suitable valve actuating coupling members, either directly or indirectly.

In addition, the invention preferably includes stainless steel sheathed titanium valves and titanium rocker arms to provide a strong, low mass valve system.

The combination of the eccentric camlobe and cam-follower in the new cam system has the beneficial effects of positive, self-contained valve actuation action without the known power robbing effects and additional stress of valve springs. In addition, precise control of the opening/closing valve events by this cam system greatly reduces or eliminates the symptoms of valve float, which traditionally have been a primary factor in limiting high engine speeds. The present invention provides gentle opening/closing action at the valve seat through strong impact absorption of inertial forces. The mechanical leverage advantage, combined with multi-point force contact due to large surface area interaction of the eccentric camlobe with the long axis of the cam-follower during the opening/closing phases, allows both rapid acceleration and/or deceleration. The new cam system also provides high terminal velocities of the valve with the inertial-mass cushioning features at maximum lift and at a full closure. The lack of valve springs in the design of the positive closure actuation embodiment of the present invention results in reduced internal frictional and inertial resistance. This contributes higher motive force to the engine's specific output of power.

All these features of the present invention, combined with a long dwell duration at maximum lift, are conducive to high volumetric gas flow efficiency and to dynamic charge swirl shaping while extending overall engine speed potentials. Modification of the cam-follower to allow rotational variations of the cam follower in its attack point, and in relation to the eccentricity of the camlobe, creates a situation where the valve event timing can be externally and dynamically controlled to allow maximization of various engine performance parameters during any point in the engine's rpm bandwidth. Further modification of the cam-follower to allow external control of the internal length of the major axis with synchronous corresponding adjustment of the length of the eccentric camlobe's longest radius creates a situation where the timing, duration, and lift in various combinations may be altered to suit the most favorable dynamic engine performance criteria. The cam system of the invention is a simple, yet sophisticated and versatile, solution for increasing an engine's performance.

The present invention is especially suited for motorcycle engines because it provides a valve actuating system which can operate at high speed with low mass inertia. The system is very flexible in its ability to vary valve timing with changing engine needs, and it also improves engine efficiency by control of valve lift and valve open and closed periods.

In a preferred form, a circular cam of the invention has an eccentric axis or axle which is adjustable in position relative to the geometric center of the cam. Further, the long axis of the cam-follower is similarly adjustable by a multicomponent telescoping structure; and the cam-follower is also rotatable relative to the cam. These structural features provide a cam system which has adjustable lift, adjustable dwell and adjustable timing. Controls responsive to engine needs render the features automatic in nature.

BRIEF DESCRIPTION OF THE DRAWINGS

Other objects and inherent advantages of the invention will become apparent upon reading the following detailed description and upon reference to the drawings in which.

Figure 1:
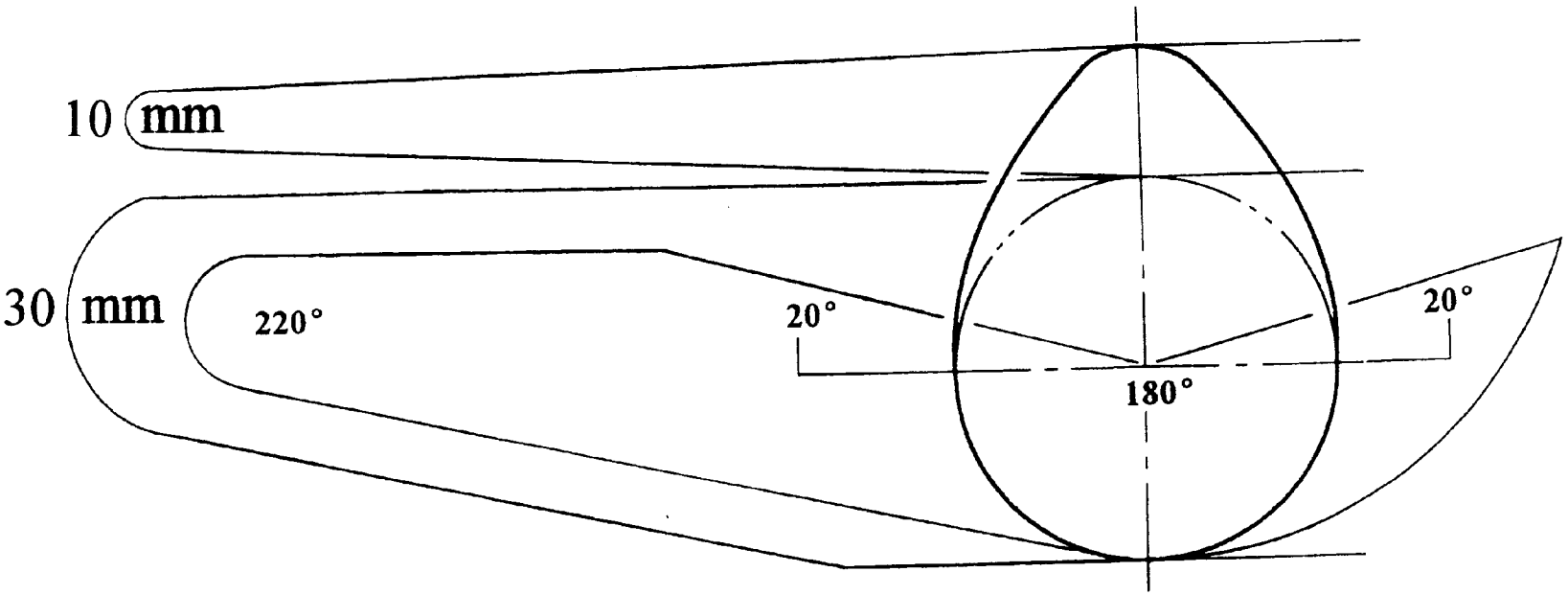
FIG. 1 is a conventional cam system.

While the invention is susceptible to various modifications and alternative forms, specific embodiments have been shown by way of example in the drawings and are described in detail. It should be understood, however, that the description herein of specific embodiments is not intended to limit the invention to the particular forms disclosed. On the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below as they may be employed in a cam operating system. In the interest of conciseness, not all features of an actual implementation are described in this specification. It will, of course, be appreciated that in the development of any actual embodiment, numerous implementation-specific decisions must be made to achieve the developer's specific goals, such as compliance with system-related and business-related constraints. Moreover, it can also be appreciated that even if such a development effort may appear complex and time-consuming, it is nevertheless a routine undertaking for one of ordinary skill having the benefit of this disclosure.

Thus, it is a general cam design technique to employ a displacement-time diagram in which the time axis is laid off in degrees of cam rotation. Displacements of the follower and periods of dwell are selected and indicated on the diagram and connected by suitable curves. Examples of curves are cylindrical, constant acceleration/constant deceleration, catenoidal, etc. Profiles of cams are then typically based on such diagrams. In the present invention cam-follower profiles are typically based on such profiles.

FIG. 1 illustrates a typical camlobe of the prior art. The dimension of the camlobe is extended from the diameter of the base height and defines the valve lift. In the embodiment shown the valve closed dwell period is approximately 220 degrees of camshaft rotation.

Figure 2:
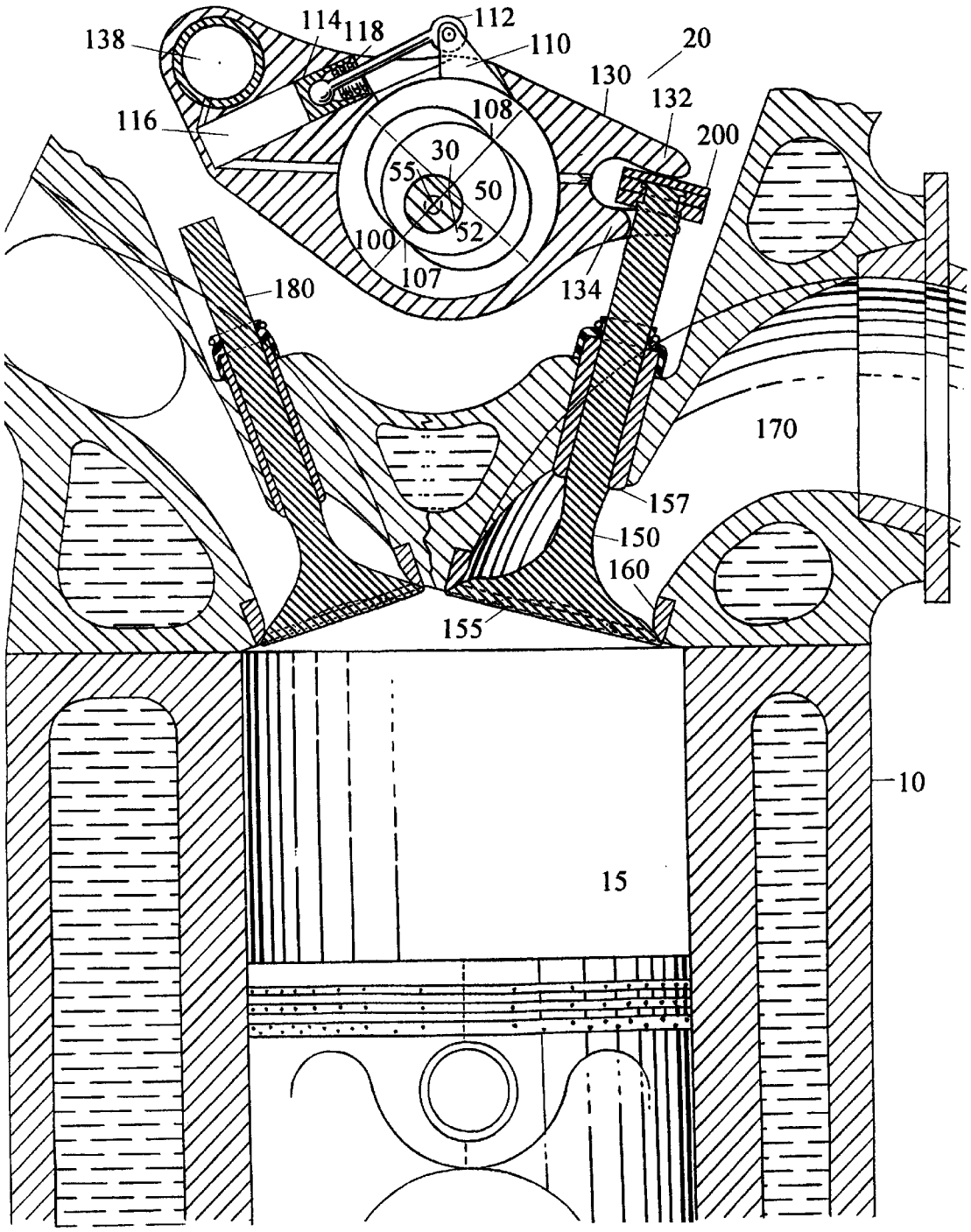
FIG. 2 is a cross section of a cam system according to the present invention at a starting position and zero advance in the rotation of the camlobe.

FIG. 2 illustrates one embodiment for a cam system 20 in accordance with the invention as implemented in an internal combustion engine 10. The cam system 20 includes an eccentric camlobe 50 surrounded and restrained by a cam-follower 100. Camlobe 50 rotates about a noncentral axis 55, driven by camshaft 30. An applied rotational force causes the camlobe 50 to orbitally rotate, slide or otherwise move in a clockwise manner along the inner surface 105 of the cam-follower 100 exerting a force against it. This force is transformed into a reciprocating linear movement that is utilized to open and close valve 150. For clarity, the cam system 20 is shown connected to valve 150, which may be an intake or exhaust valve in the engine 10, although in function both valves 150 and 180 as well as other valves in the engine system can and will be driven by a common cam system of which the specific camlobe 50 and cam-follower 100 are parts. The valve 180 has a separate camlobe and follower, not shown.

This valve actuation force created by the rotation of the camlobe 50 about the inner surface of cam-follower 100 may be transferred to the valves 150 indirectly (as shown in FIG. 2) by the inclusion of a rocker arm assembly 130 between the cam-follower 100 and the valve 150. The indirect type is used primarily for its mechanical leverage ratio lift-amplification design advantage. The unified rocker arm assembly as shown includes an upper or opening rocker arm 132, a lower or closing rocker arm 134, and a fixed fulcrum point 138. As the eccentric camlobe 50 rotates orbitally (and clockwise in FIG. 2 and FIG. 11) in the direction of camshaft 30 rotation, the effective lever length of the rocker arm assembly 130 varies. Generally, a shorter effective primary lever length is desired at the opening phase of valve lift to provide the greatest lift amplification at the valve. The leverage factor then gradually diminishes as the eccentric camlobe 50 continues its rotation increasing the effective lever length to its greatest value (least lift amplification), and this is generally desired at the initiation of the valve closing phase to assist in a gentle landing at the valve seat. This variable leverage feature is illustrated in the intake components shown in FIG. 11.

This embodiment provides positive open and closing of the valve. In other embodiments the assembly may include an opening rocker arm and a spring to bias the valve to a closed position in place of the fixed closing rocker arm. Alternatively, the cam system 20 may be directly connected to the valve 150, meaning the rotated cam-follower acts directly on the valve. The assembly 130 may also include lifters and pushrods or other structures commonly used in the art to maintain, amplify, or reduce the forces transferred to the valves.

The eccentric camlobes and the cam-followers of the present invention allow the amounts of gas flow through the combustion chamber 15 of the internal combustion engine 10 to be varied during intake and exhaust cycles through improved control of the lift, duration, and overlap of the valves 150 and 180. In overview, the present invention provides a high-speed, low-mass inertia valve actuating system that has the ability to vary both the timing of valve opening and closing, amount of valve lift, and the duration of the valve open and closed periods. These features provide for a more efficient internal combustion engine, with higher specific torque and power and/or reduced fuel consumption and/or emissions.

FIG. 2 illustrates one embodiment for a cam system 20 in accordance with the invention implemented in an internal combustion engine 10 (e.g., a four-stroke engine). The system comprises an eccentrically driven circular camlobe 50 surrounded and restrained by the cam-follower 100. The camlobe 50 is an eccentric camlobe because the axis of rotation 55 is non-central, that is, it does not pass through the center 52 of the camlobe 50. The axis or axle of rotation 55 corresponds to the camshaft 30 coupling location along the diameter of camlobe 50.

The axis or axle of rotation 55 is offset from the center 52 of camlobe 50 by a particular distance preselected to comply with certain design objectives. The amount of offset may be varied either between cam systems or dynamically within an individual cam system.

The eccentric camlobe 50 is contained and constrained within the cam-follower 100. In the system 20 of FIG. 2, the cam-follower 100 has an inner surface 105. The cam-follower shown in FIG. 2 has its inner surface 105 configured in an oval or ovoid shape. The terms oval and ovoid describe generally elliptical forms, or generally elliptical forms with two parallel flat sides which create a major or long axis. In a sense, the follower's surface resembles an oval race track having two parallel straight-away sections and two rounded end sections. In FIG. 2 sides 107 and 108 are parallel to the long axis, and a minor or short axis is perpendicular to flat sides 107 and 108. The short axis of the cam-follower 100 is nominally equal to the diameter of circular camlobe 50, with a minimal difference for operational running clearance and an oil film layer. As a result of the near-equivalence of the camlobe 50 diameter and the short axis of cam-follower 100 the two components remain closely coupled. This multi-point contact resulting from the high surface area contact between the camlobe 50 and cam-follower 100 helps to maintain accurate control and transference of forces, resulting in better valve timing accuracy. However, although the diameter of the camlobe 50 is approximately equal to the length of the minor axis of cam-follower 100, other diameters are possible without departing from the inventive concepts described herein.

Figure 11:
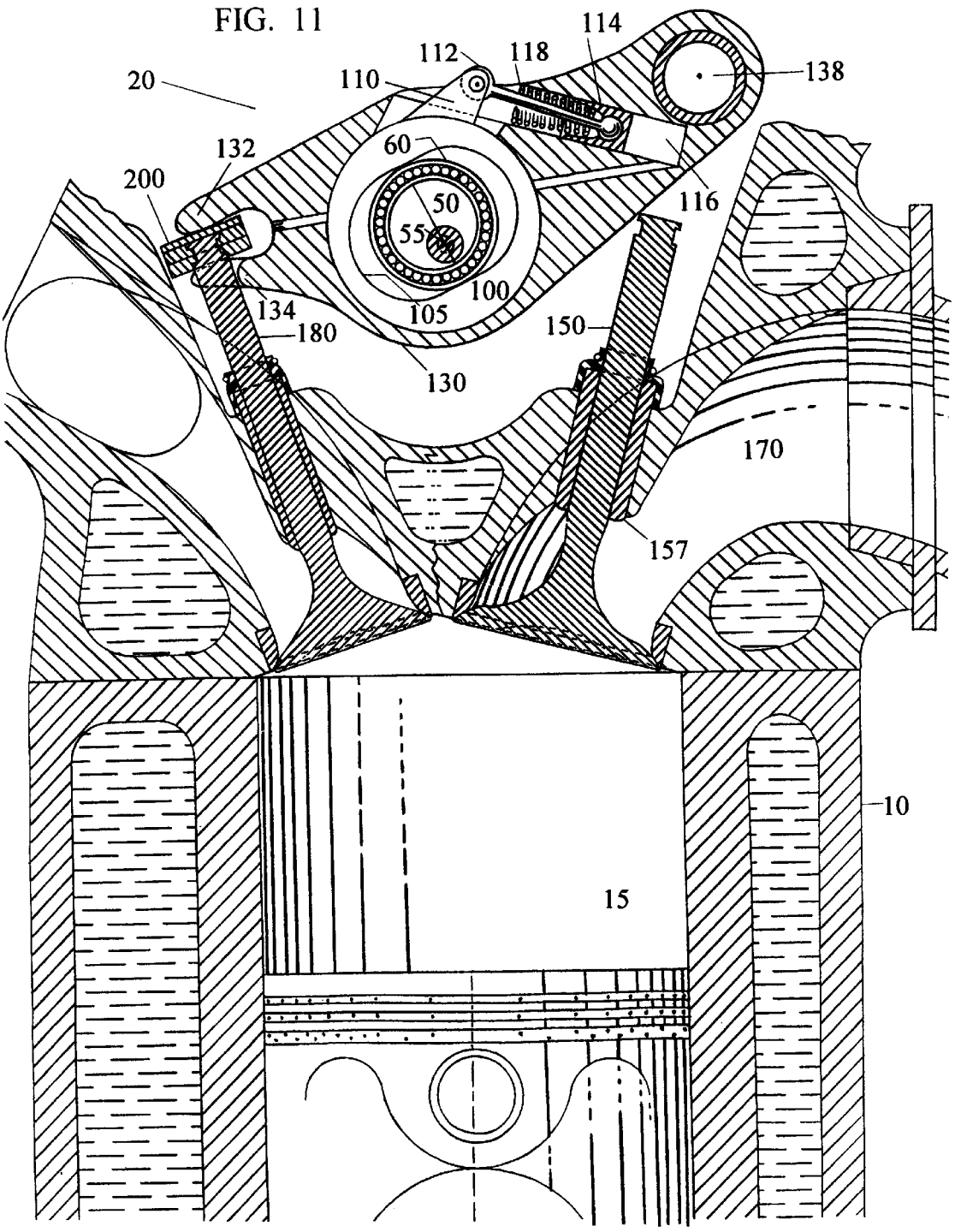
FIG. 11 is a cross section of the cam system of the current invention including bearings between the camlobe and cam-follower.

Alternatively, the outer circumference of camlobe 50 may include bearings to achieve a lower coefficient of friction at the interface between eccentric camlobe 50 and the inner surface 105 of cam-follower 100. FIG. 11 illustrates the inclusion of frictionless bearings 60 in cam system 20. The choice of bearing type, e.g., roller bearings, ball bearings, or needle bearings, is a finction of design interests, including friction coefficient and load capacity. Additionally, the thickness variations in conventional bearings will also play into the design choice, since thicker bearings such as ball bearings have a greater impact on valve timing and lift than thinner bearings such as needle bearings. This alternative embodiment reduces the coefficient of friction at the interactive surfaces between the camlobe 50 and the cam-follower 100, resulting in less wear on the valve system. The reduction in friction can result in an overall increase in engine speed.

Figure 2A:
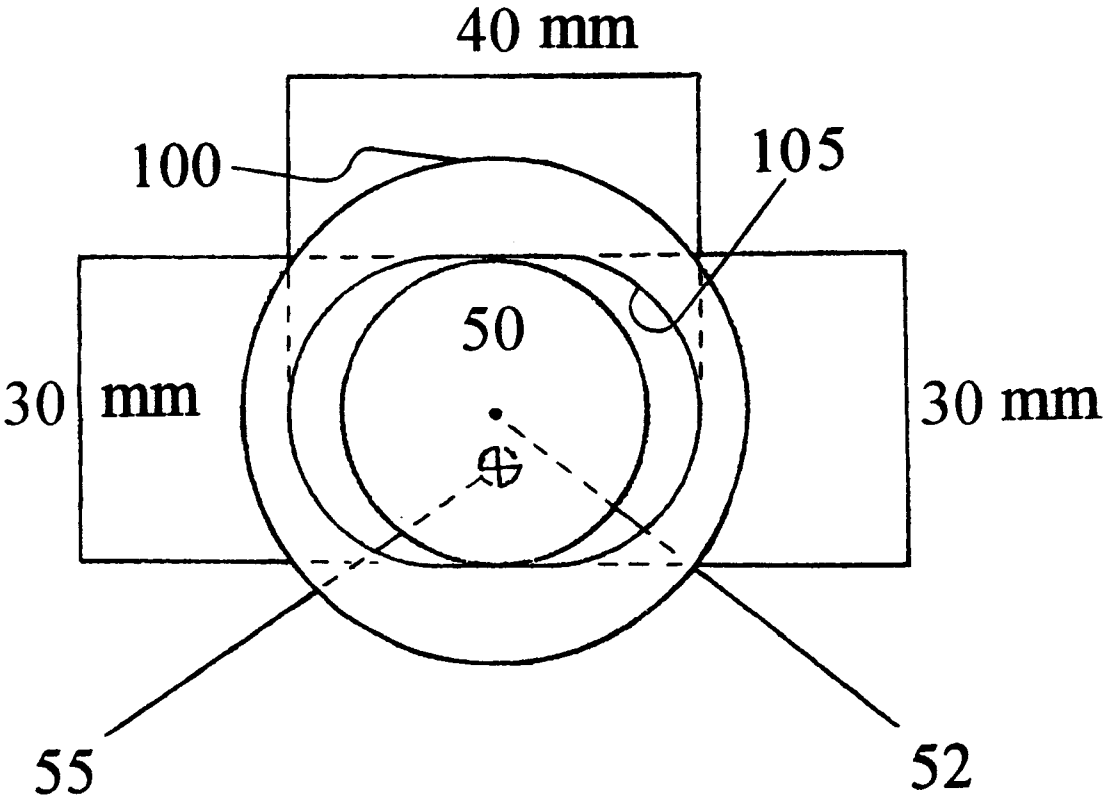
FIG. 2A is a schematic view of a cam assembly showing a set of elementary dimensions.
Figure 2B:
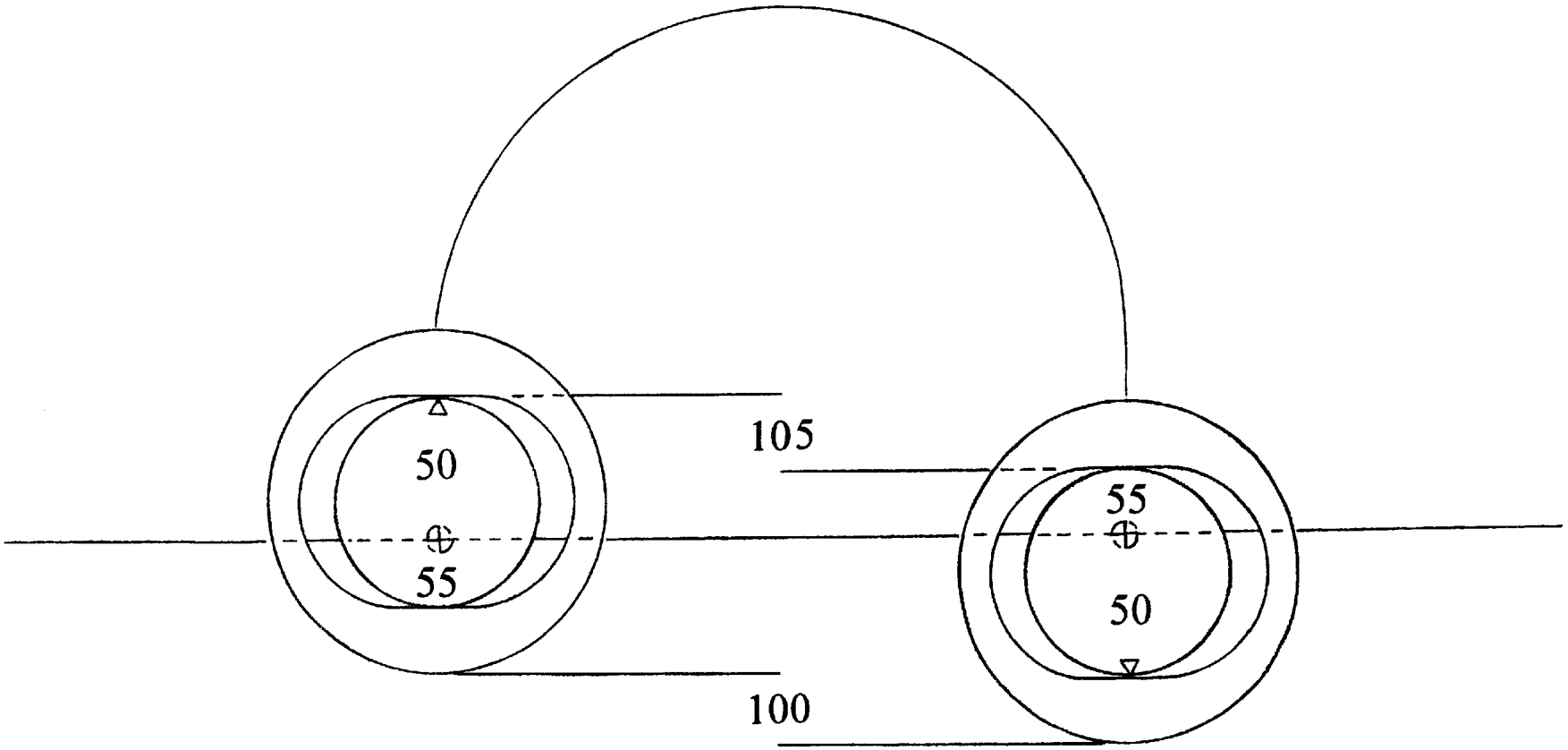
FIG. 2B shows two schematic views of the cam system of FIG. 2A with the cam displaced 180 degrees between the two views.

Returning to FIG. 2, as an example, it may be desired that valve 150 has a nominal valve lift of 10 mm. Ignoring for purposes of this example considerations such as valve thermal expansion, since these can be addressed in conventional manners such as shimming without changing the system of the current invention, exemplary dimensions and interactions of the camlobe 50 and cam-follower 100 are discussed. FIG. 2A schematically illustrates the camlobe and cam-follower of FIG. 2, and represents exemplary component dimensions. Camlobe 50 has a diameter of 30 mm, and a rotational axis 55 offset from the center point by 5 mm. The cam-follower 100 has an inner surface 105 of ovoid form, with a short axis nominally 30 mm and a long axis nominally 40 mm. As shown in FIG. 2B, the desired 10 mm of valve lift through one hundred eighty degrees of camlobe rotation is a finction of the amount of offset of the rotational axis 55 of camlobe 50 and the difference between the length of the long axis and the length of the short axis. The valve lift is equal to the amount of vertical displacement along the short axis of cam-follower 100 which contains the eccentric camlobe 50.

Figure 3:
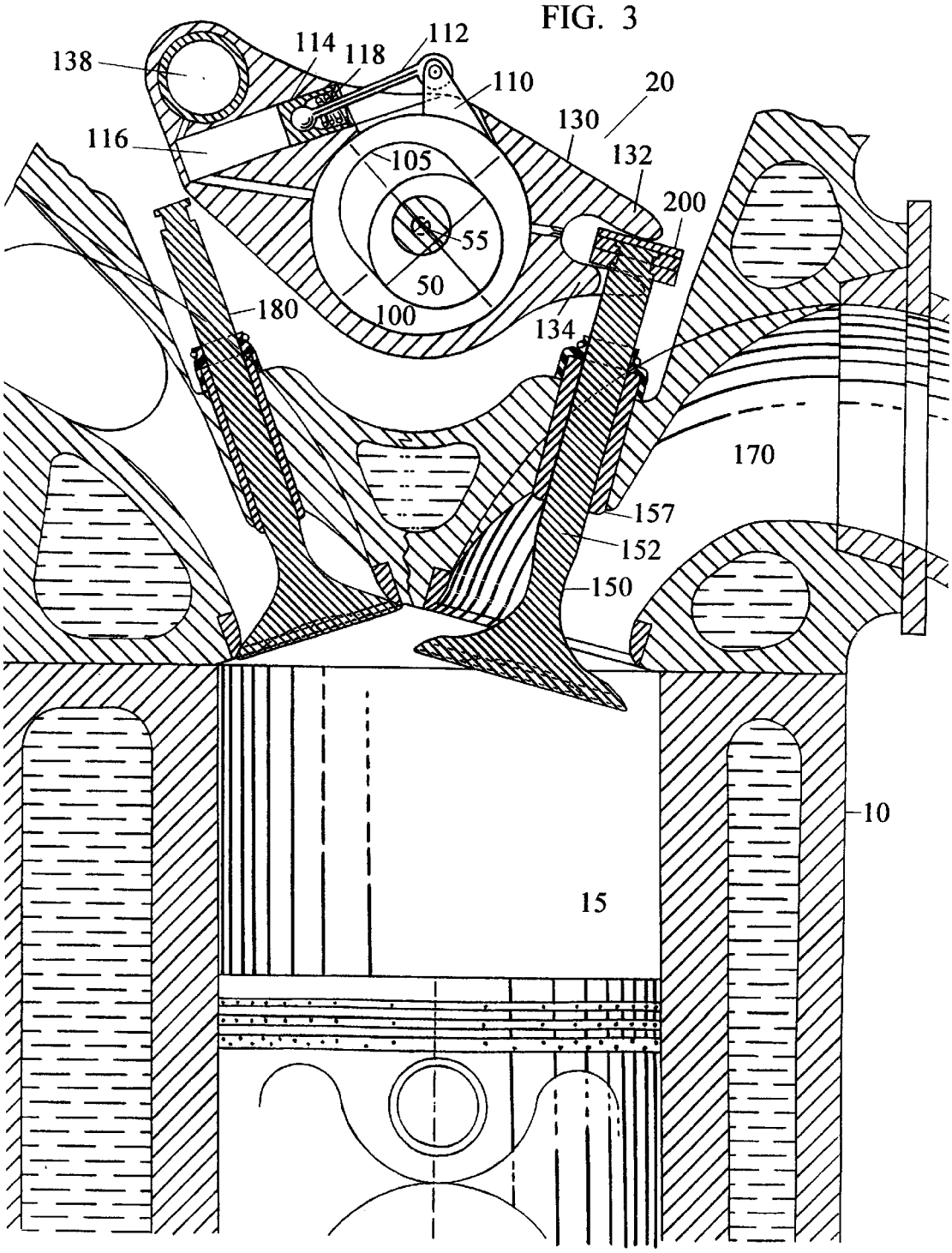
FIG. 3 is a cross section of the cam system of FIG. 2 with the camlobe rotated 90 degrees and with zero advance.

In FIG. 2, the valve 150 is in the closed position, with the sealing end of valve body 155 positioned against valve seat 160, defined by a cylinder head, to prevent the flow of gases into or out of the combustion chamber 15 through port 170. In FIG. 3, the camlobe 50 is rotated ninety degrees. The orbital displacement of the camlobe 50 as a result of its rotation is transferred to cam-follower 100 which is displaced in a downward direction. Horizontal movement of the cam-follower 100 is limited by rocker arm assembly 130, resulting in substantially linear movement. Thus, opening rocker arm 132 is displaced along the longitudinal axis of valve 150 as a result of the restraint of fulcrum point 138. A valve keeper 200 couples opening rocker arm 132 (and closing rocker arm 134) to the valve stem 152 at the actuated end of valve 150. Accordingly, the valve 150 is moved downward into a partially opened position in FIG. 3 allowing flow through port 170. The orbital displacement of the camlobe 50 as a result of its is rotation is transferred to cam-follower 100 which is displaced in a downward direction. Horizontal movement of the cam-follower 100 is limited by rocker arm assembly 130, resulting in substantially linear movement of the rocker arm 132 where it contacts the valve keeper 200. This applied force on opening rocker arm 132 is displaced along the longitudinal axis of valve 150 as a result of the restraint of fulcrum point 138. The valve keeper 200 couples opening rocker arm 132 (and closing rocker arm 134) to valve stem 152. Accordingly, the valve 150 is moved downward into a partially opened position allowing flow through port 170.

Figure 4:
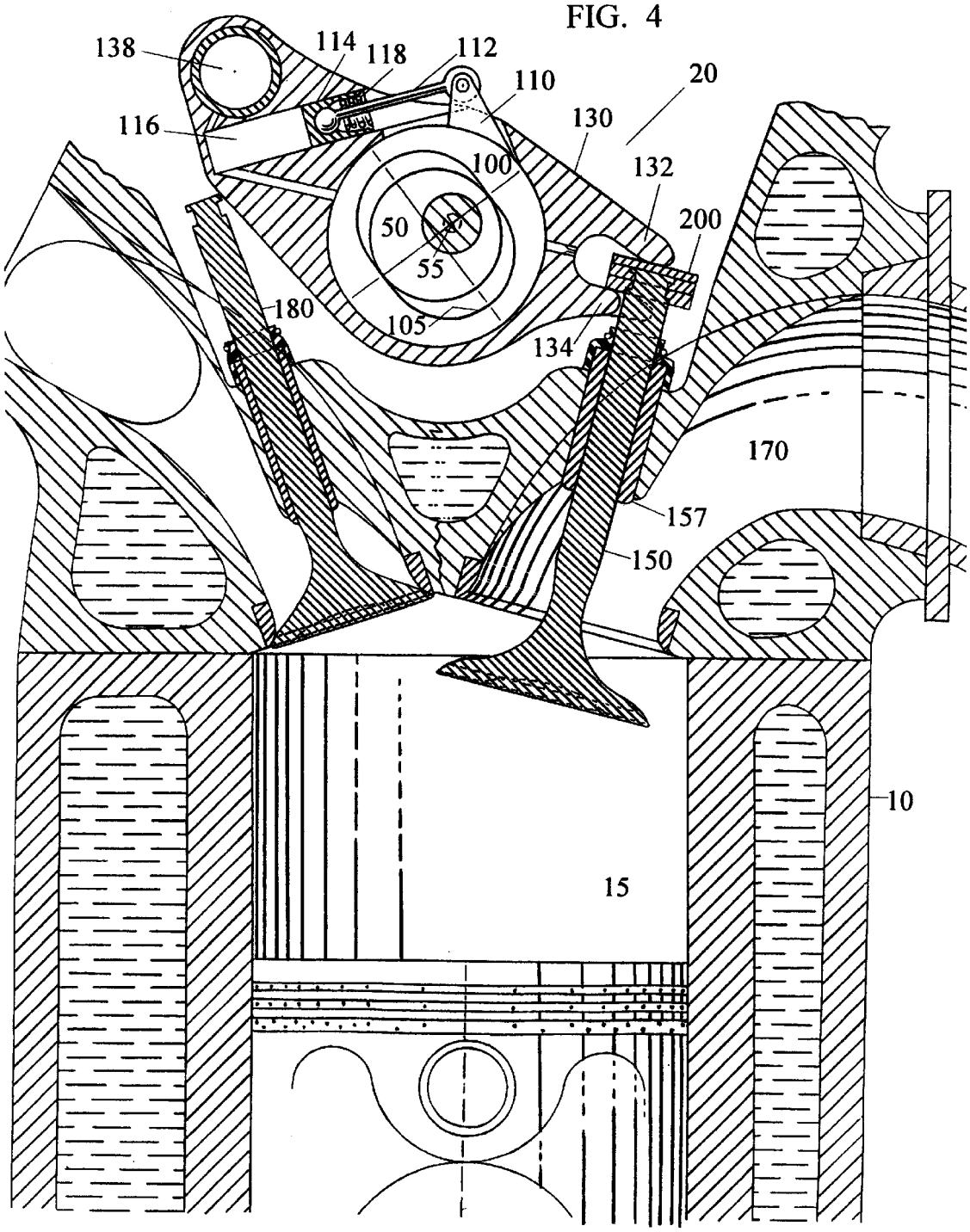
FIG. 4 is a cross section of the cam system of FIG. 2 with the camlobe rotated 180 degrees and at zero advance.
Figure 5:
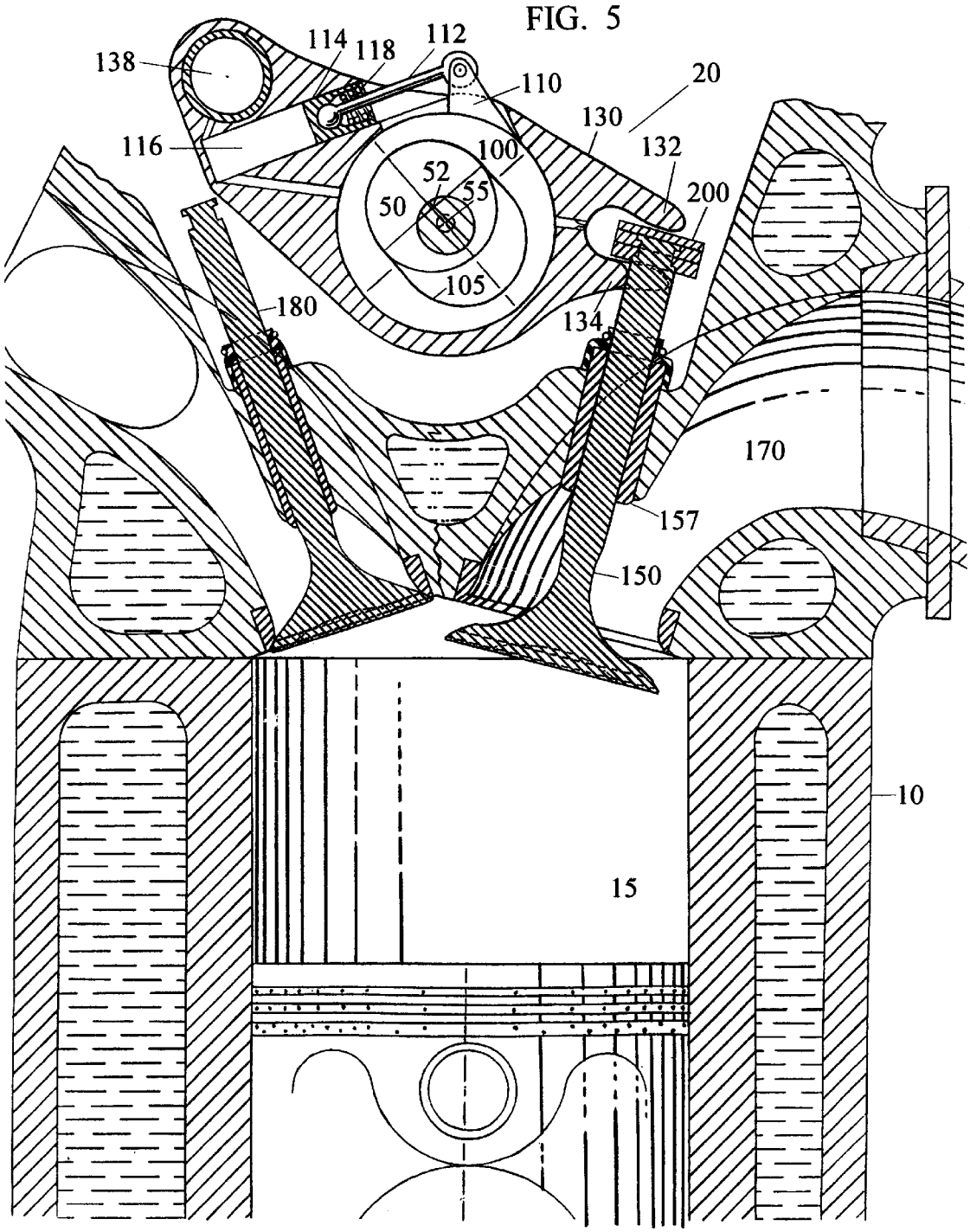
FIG. 5 is a cross section of the cam system of FIG. 2 with the camlobe rotated 270 degrees and at zero advance.

In FIG. 4, camlobe 50 has rotated one hundred eighty degrees. Maximum cam lift of 10 mm is achieved with valve 150 in full-open position. Further rotation of the camlobe 50 begins the closing cycle. In FIG. 5, camlobe 50 has rotated two hundred seventy degrees, and valve 150 is partially closed at the midway point of the valve closing phase.

The amount of linear displacement of the valve 150 may be controlled by adjusting the amount of eccentricity of the axis of rotation 55 of camlobe 50. The long radius of the eccentric camlobe 50, measured from the axis of rotation 55, when rotated a full three hundred sixty degrees defines the circumference of a circle whose diameter provides the gross measurement of the long axis of the ovoid form 105 of the cam-follower 100. The gross measurement of the short axis is substantially the same as the diameter of camlobe 50.

The measurable amount of the adjustable lift feature of the invention is primarily the result of varying the eccentricity of the camlobe 50. If the rotational center point 55 of the eccentric camlobe 50 is concentric with the center 52 to FIG. 5 in the Illustrations of the camlobe 50 (i.e., eccentricity=0), cam system 20 would yield no net deflection of the cam-follower 100 along the minor axis, providing zero lift because all the radii in the cam system 20 are then equal. The theoretical maximum amount of eccentricity and lift occurs by placing the camlobe's rotational axis beyond the camlobe's circumferential edge creating a state wherein the camlobe's longest radius is at least as long as the camlobe's diameter. There is also a corresponding relationship between the length of the cam-follower's major axis and the amount of lift, which enables varying amounts of lift to occur, synchronized with the corresponding eccentricity of the camlobe.

Figure 6:
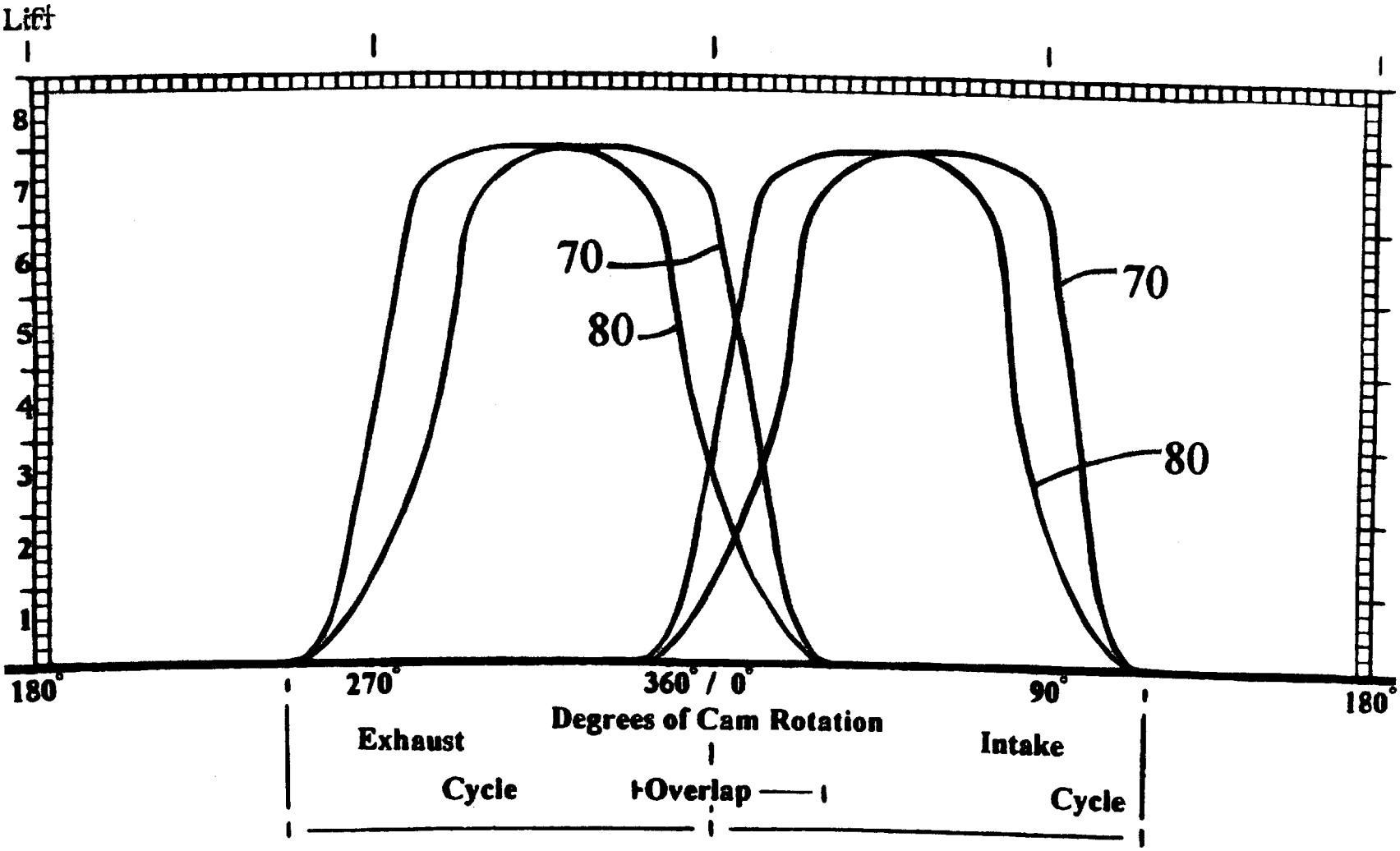
FIG. 6 is a diagram comparing valve lift for intake and exhaust valves against degrees of camlobe rotation for a cam system according to the present invention and a conventional cam system.

FIG. 6 is a graphical plot of valve lift as a finction of degrees of cam rotation. The squared curve 70 represents the result of the cam system of the current invention. Compared to the prior art cam's conventional curve 80, the cam system of the current invention provides quicker valve opening, a longer period of maximum valve lift, and quicker valve closing.

Specifically, as FIG. 6 illustrates, the cam system of the current invention provides a more rapid acceleration and quicker achievement of terminus velocity in the opening of a valve when compared to conventional cam designs. The ramp of the valve opening curve has a much greater initial rise than a conventional cam system. In addition, the valve has a longer time period (dwell) at the full open position. During the closing phase, a valve in the cam system of the current invention closes more rapidly (after longer duration of maximum lift) but still provides a soft landing.

Air and gas flowing through the intake/exhaust ports is reflected by the areas under the curves in FIG. 6. There it can be seen that the sinusoidal curves of conventional cam systems provide less intake charging ability under the intake curve, and less exhaust scavenging ability under the exhaust curve than the cam system of the current invention. An ideal curve for a valve would actually be square; the valve would open to its full-open (maximum lift) position instantaneously, would remain at maximum lift for the required duration of camshaft rotation, and would then instantly close. In that regard, the curve produced by the lift and duration characteristics of a camlobe/cam-follower system of the invention more closely approximates this ideal curve than conventional cam systems.

In another embodiment, the cam-follower 100 may be rotated bi-directionally (clockwise or counter-clockwise) from a fixed reference point. The fixed reference point provides a baseline standard for valve timing in a typical set of engine operation and performance conditions. Over the course of the rpm band of a particular engine, the performance desired may be altered in response to changes in one or more operating parameters, for instance, desired or required changes in the torque and horsepower output plotted against rpm. In the case of an engine operating at low rpm, increased torque may result from altering the timing of the exhaust and intake valves' opening and closing to minimize overlap. In the case of an engine operating at high rpm, long overlap may be desired to provide a larger net volume of fuel-air mixture charge in the combustion chamber.

Figure 7:
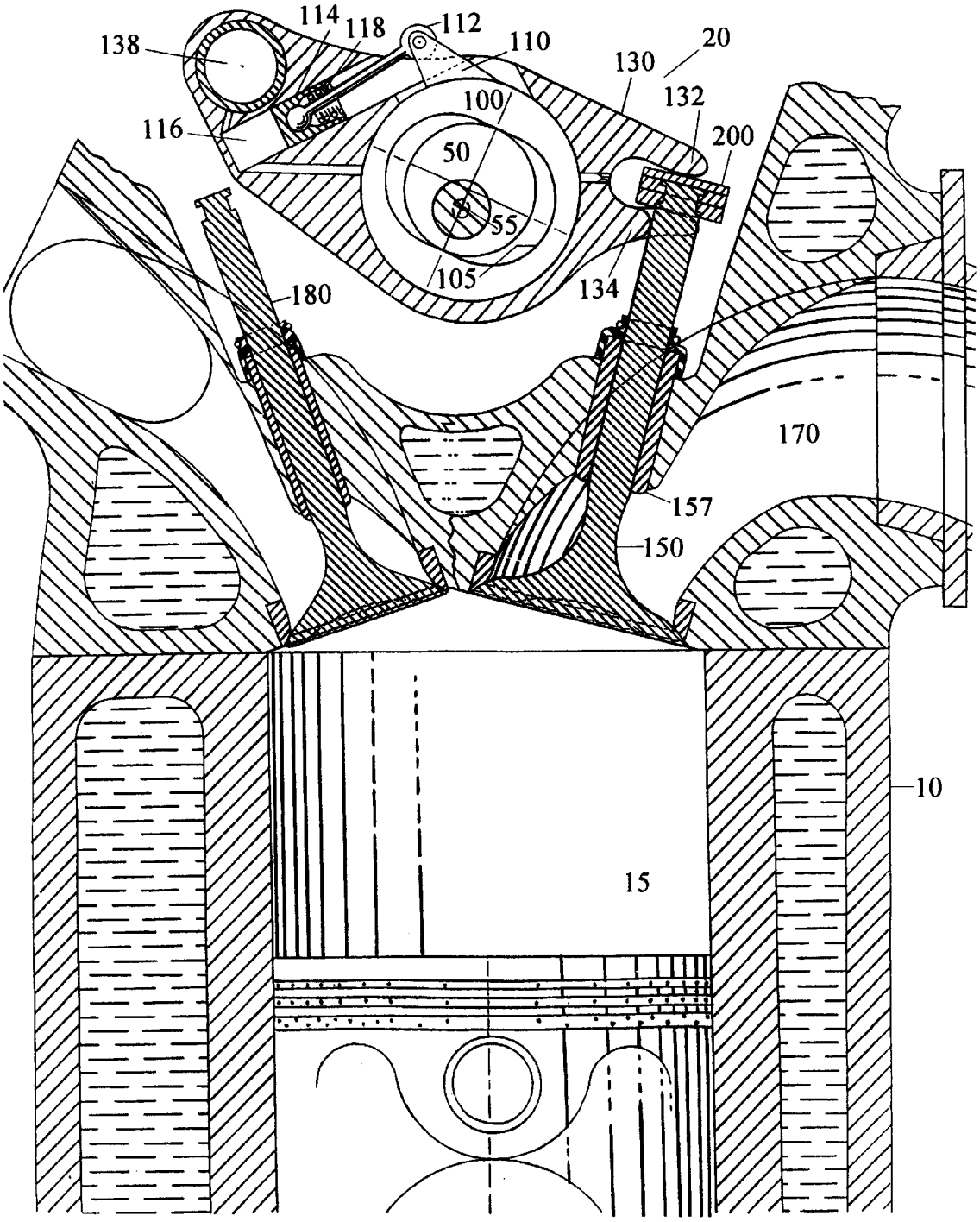
FIG. 7 is a cross section of a cam system according to the present invention at a starting position in the rotation of the camlobe, with the cam-follower rotationally advanced.

In the cam system shown in FIG. 7, the moments of the interaction between camlobe 50 and cam-follower 100 have been altered by rotating (advancing) the cam-follower 100 counter-clockwise about the fixed reference point. As such, in this embodiment, the cam-follower 100 is variable. In the embodiment shown, the variable cam-follower 100 is mounted and contained within the rocker arm assembly 130 to stabilize the cam-follower and reduce or minimize horizontal deflection while remaining free to guide the eccentric camlobe 50 and valve 150 in linear movement. Similarly, in other embodiments of the invention other types of rocker arm assemblies, or restraining apparatus in the case of a directly operating cam system, may be employed. Variable cam-follower 100 is shown in a partially advanced position, however, camfollower 100 may be rotated bi-directionally to advance or retard the operating characteristics as may be required.

Figure 8:
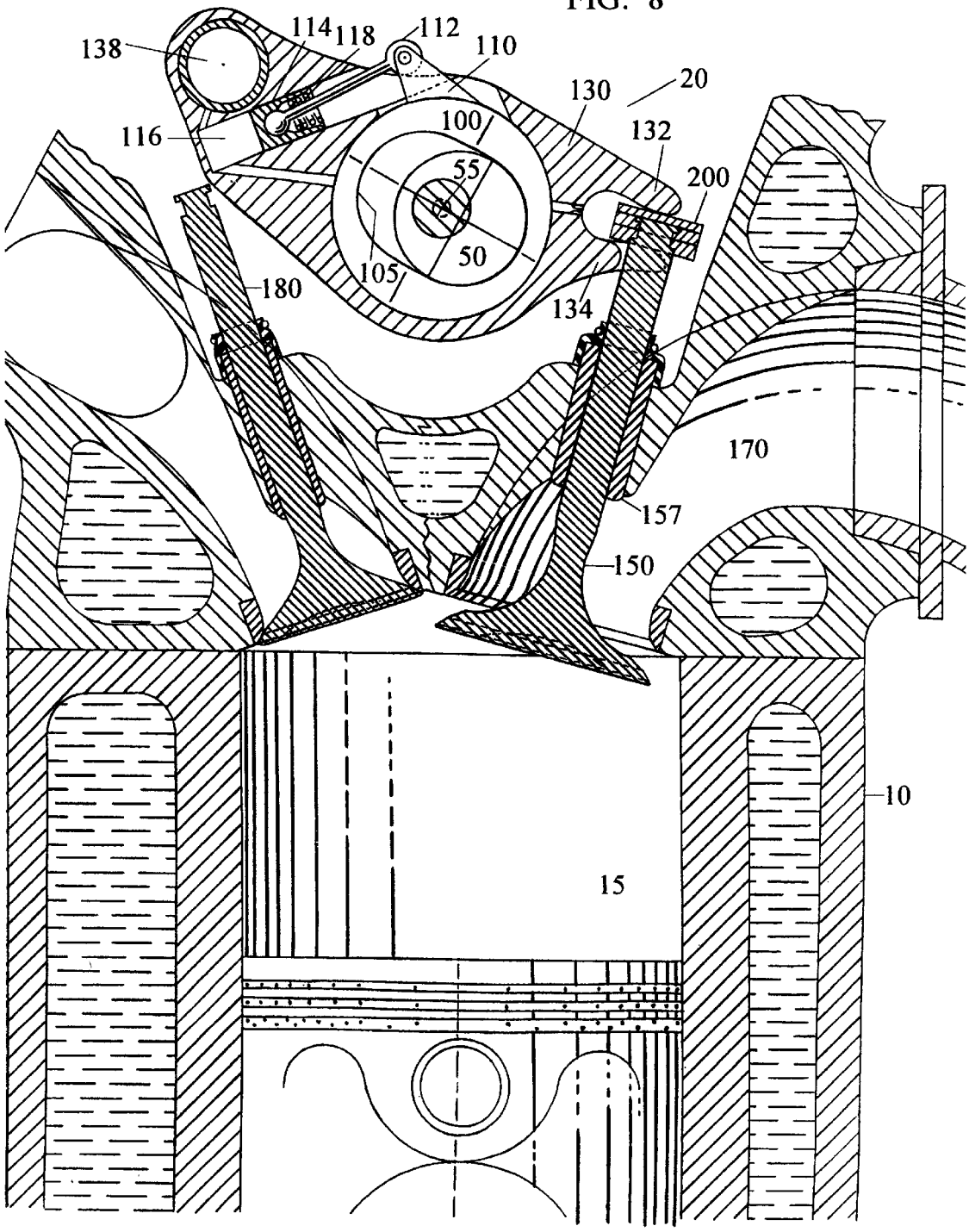
FIG. 8 is a cross section of the cam system of FIG. 7 with the camlobe rotated 90 degrees.
Figure 9:
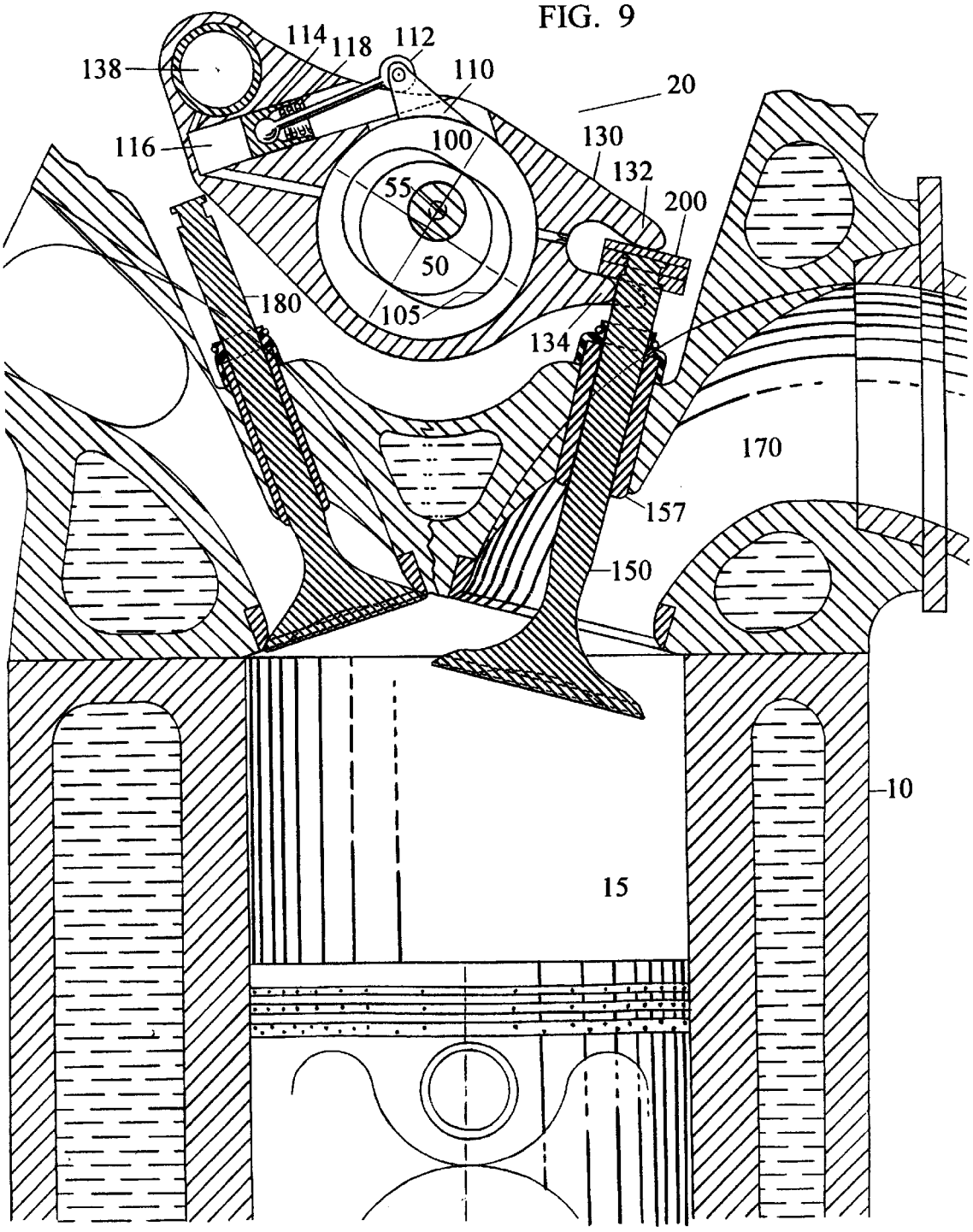
FIG. 9 is a cross section of the cam system of FIG. 7 with the camlobe rotated 180 degrees.
Figure 10:
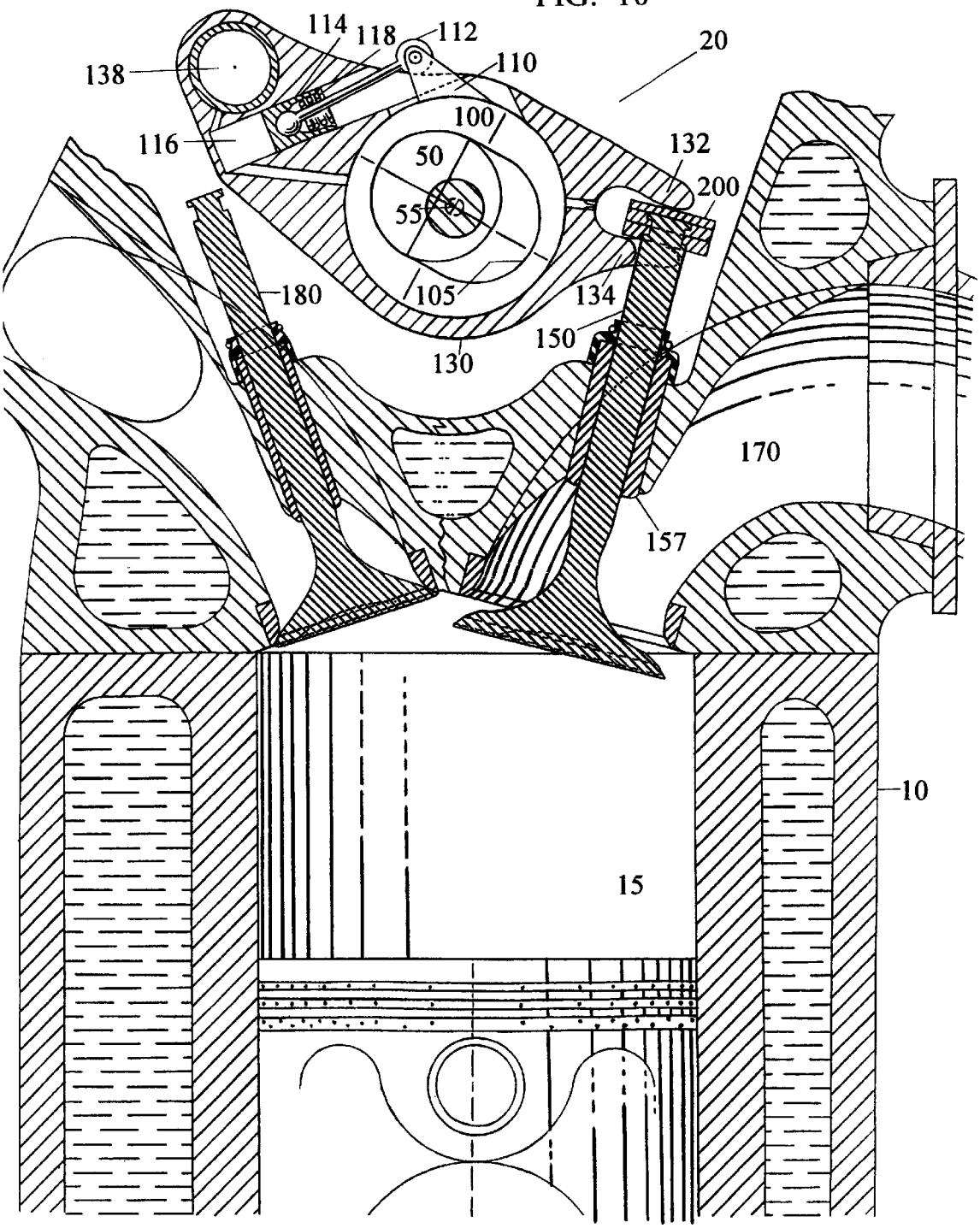
FIG. 10 is a cross section of the cam system of FIG. 7 with the camlobe rotated 270 degrees.

In FIG. 7, the cam-follower 100 is partially advanced relative to FIG. 2, in which the cam-follower is in a neutral (reference) position—in both figures the camlobe 50 has not yet been rotated and the valve 150 is in the closed position. In FIG. 8, which is comparable to FIG. 3, the camlobe 50 is rotated clockwise ninety degrees. The result of the partial advance of the rotatable cam-follower 100 in FIG. 8 is that the timing of the opening and closing for valve 150 is altered because the points at which the opening and closing events occur in the rotation of the camlobe 50 are changed. As may be seen by comparing FIG. 8 and FIG. 3, the initial attack trace position at which camlobe 50 has traveled through ninety degrees of camshaft rotation is not the same. This is due to the partial advance of cam-follower 50.

Fundamentally, the variation of the onset and initiation of the valve opening phase and the corresponding change in the completion of the valve closing phase is a direct result of the placement of the cam-follower 100 in relation to the rotating camlobe 50. The number of degrees of advance or retard from a median reference point of the cam-follower results in a consequent amount of change in degrees of camlobe rotation necessary to initiate a valve event as the camlobe rotates and attacks the inner circumference of the cam-follower. The valve event's curve of actuation shifts by a like number of degrees, and the valve event occurs relatively earlier or later. The valve lift occurring during camshaft rotation, when expressed as a curve, reflects the same shift when influenced by the variable cam-follower 100.

Comparing FIGS. 3 and 8, both figures illustrate the camlobe 50 rotated ninety degrees from a starting point reference. However, if examined with respect to a common set of coordinate axes, it is apparent that the concurrent rotational position of the camlobe 50 occurs with a twenty degree differential due to the rotational advance of the variable cam-follower 100. In FIG. 8, the long radius of the camlobe is in an approximate 4 o'clock position, but the camlobe in FIG. 3 has rotated twenty degrees to an approximate 5 o'clock position.

A comparison of valve lift curves of the zero advance and half advance sequences would exhibit an overall 2 mm carry-over lift difference throughout the entire opening and closing phases. This is due to the effects upon the rocker arm's primary leverage ratio by the rotational placement of the variable cam-follower 100. When expressed through the rocker arm's fixed secondary lever, the lift amplification feature results in this overall 2 mm lift differential.

The rotational placement of the cam-follower 100 in relation to the camlobe 50 changes the primary lever length and overall rocker arm ratio with consequent changes to the valve lift amounts and variation of the initiation/beginning and termination/ending of the valves' opening and closing phases. Of course, when the variable cam-follower 100 is utilized in the actuation of the intake and exhaust valves 150 and 180, precise control of the timing of opening and closing, and the crucial amounts of intake and exhaust cycle overlap. The variable cam-follower can be used to determine the dynamic performance of an engine's power output.

The cam-follower 100 is rotatably mounted within the rocker assembly 130. In the embodiment shown in FIG. 3, for example, the cam-follower 100 has a flange or pivot lever-type connection 110 coupled to a first end of transfer linkage 112. In one embodiment, the opposing end of transfer linkage 112 is coupled to piston 114, which is located and slidably contained within a cam-follower hydraulic cylinder 116 formed into the body of rocker arm assembly 130.

When hydraulic fluid is forced into cam-follower hydraulic cylinder 116, increased pressure on piston 114 slides the piston to a forward position. Transfer linkage 112 attached to the cam-follower 100 translates the forward movement of piston 114 into rotation of the cam-follower 100. When the hydraulic pressure is removed, spring 118 returns the piston to its original position, allowing the cam-follower 100 to counter-rotate to its starting position. Although a hydraulically actuated-spring return system has been illustrated, pneumatic actuators, centrifugal devices, solenoids, or other electric or electromechanical devices may be used.

The position of cam-follower 100 is controlled through the actuator and transfer linkage by a controller that functions to initiate degrees of rotational variation around the fixed point relative to the variable cam-follower 100. The control devices for cam-follower 100 may be simply actuated as a preset or manually adjusted mechanical controller mechanism, and/or may be based on existing internal engine support systems such as the hydraulic bearing lubrication circuits (driven by the engine rpm variable output pressure supplied by the oil pump), or on the air pressures in the intake or exhaust tracts. The actuation may be electronically controlled based on one or more Application Specific Integrated Circuits (ASICs) or microprocessors receiving data input from attendant engine parameter sensors.

Alternatively, the existing engine electronic control units (ECUs), EPROMs, and support sensors may provide the data acquisition to control the adjustments of the variable cam system, in addition to their traditional functions such as controlling the fuel injection and ignition systems. These computerized packages may include multiple microprocessors that provide instantaneous, peripheral parametric-sensory input data while comparing/contrasting it to the data that is filtered through standard data-sets. The specifics regarding the controller have not been included so as not to obscure the present invention, since they would be understood by a person skilled in the art. The present cam system can be fully adapted to the future designs utilized in state-of-the-art electronic applications currently in use in the fields of automotive and mechanical engineering.

A purpose of the controller is to adjust the rotational attitude of cam-follower 100 in relation to the camlobe 50 as a response to engine changes or performance demands. This is a dynamic process that allows peripheral input data to be converted to a force that is mechanically transferred to the cam-follower 100 and the camlobe 50 by hydraulic, electrical, centrifugal, electromechanical, or pneumatic means. The change in attitude of the cam-follower provides the ability to vary the amount of valve lift (i.e., spatial displacement) and valve timing and duration (i.e., temporal displacement) occurring at the valve head/seat areas of the combustion chamber 15 in the internal combustion engine 10.

Additional benefits may be obtained by modifying the form of the inner surface 105 of cam-follower 100. Typically, the ratio of camshaft to crankshaft speed is, 1:2 or commonly known as one-half crankshaft speed because the cam is driven at ½ crankshaft speed. (The camshaft rotates once for every two revolutions of the crankshaft.) A standard camlobe in a conventional cam system will be in the valve closed position for approximately one hundred eighty degrees of camshaft rotation (ninety degrees of crankshaft rotation). The oval or ovoid shaped cam-follower 100 has a valve closed period (valve closed dwell) lasting approximately ninety degrees of camshaft rotation. To approximate valve closed for one hundred eighty degrees of camshaft rotation, the gearing of the camshaft-crankshaft ratio must be changed to approximately 1:4 because the camshaft is driven at ¼ crankshaft speed. Alternatively, variable speed cam drive systems may be implemented.

Figure 12:
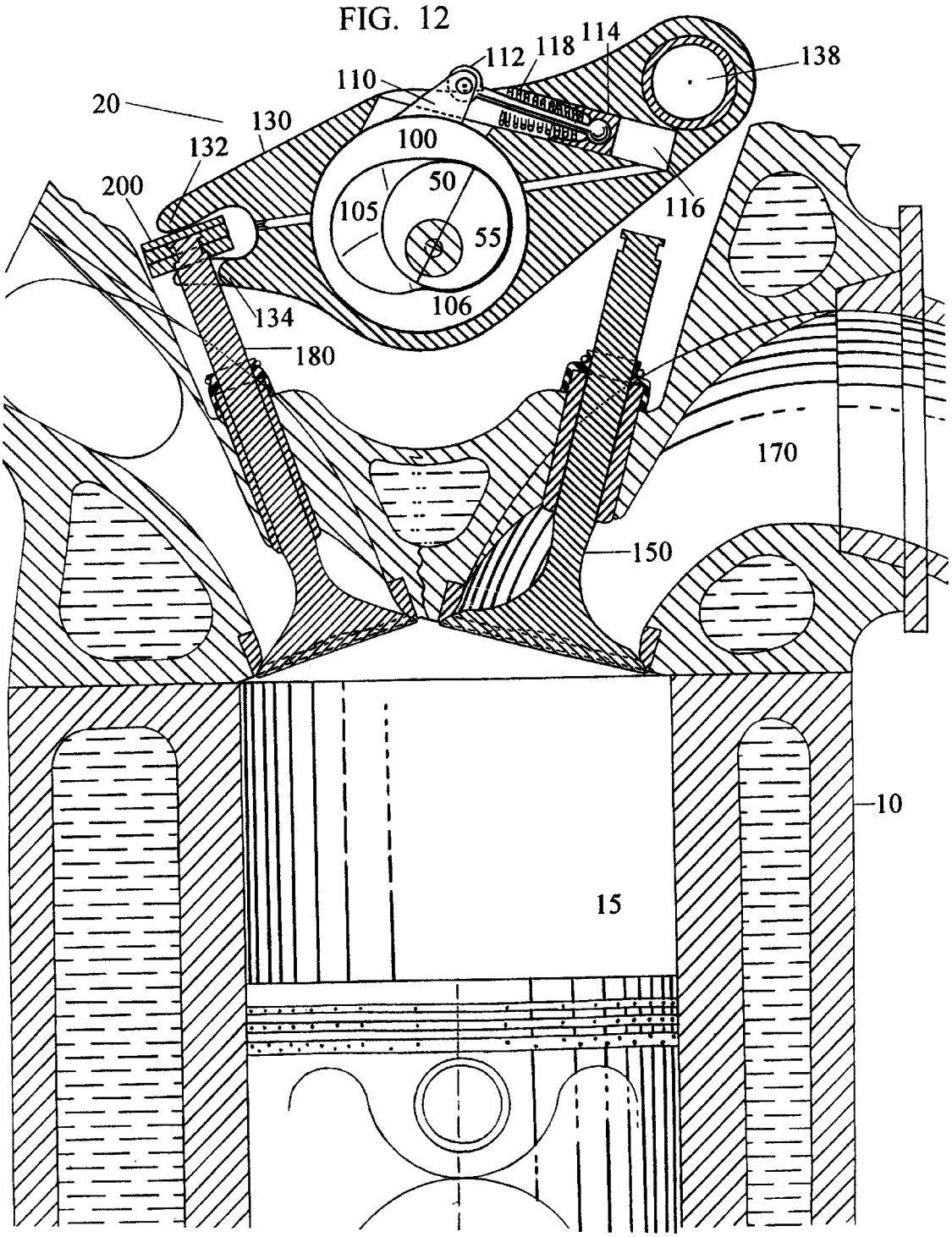
FIG. 12 is a cross section view of the cam system of the current invention showing a cam-follower with a bent elliptical shape.

In an alternative embodiment shown in FIG. 12, the inner surface 105' of the cam-follower 100 may be altered to extend the period of rotation through whichever valve 180 is closed. FIG. 12 shows the valve 180 in a closed position. The bent elliptical/asymmetric ovoid configuration 105' shown (lima-bean type shape), provides an extended period of valve closed as the camlobe 50 is rotated across the concave arcuate upper surface, and a shortened period of valve open as the camlobe 50 is rotated across the convex arcuate lower surface. In addition, the lower surface contains a small protrusion 106 which results in a short period of increased maximum lift. The valve closed period (dwell) is approximately one hundred twenty degrees in the configuration shown in FIG. 12, reducing the ratio amount of cam drive gearing required.

The bent elliptical form 105' shown in FIG. 12 is exemplary only. Many modifications may be made to the contours of the cam-follower's inner circumferential surface to meet the design requirements of particular applications.

Figure 15:
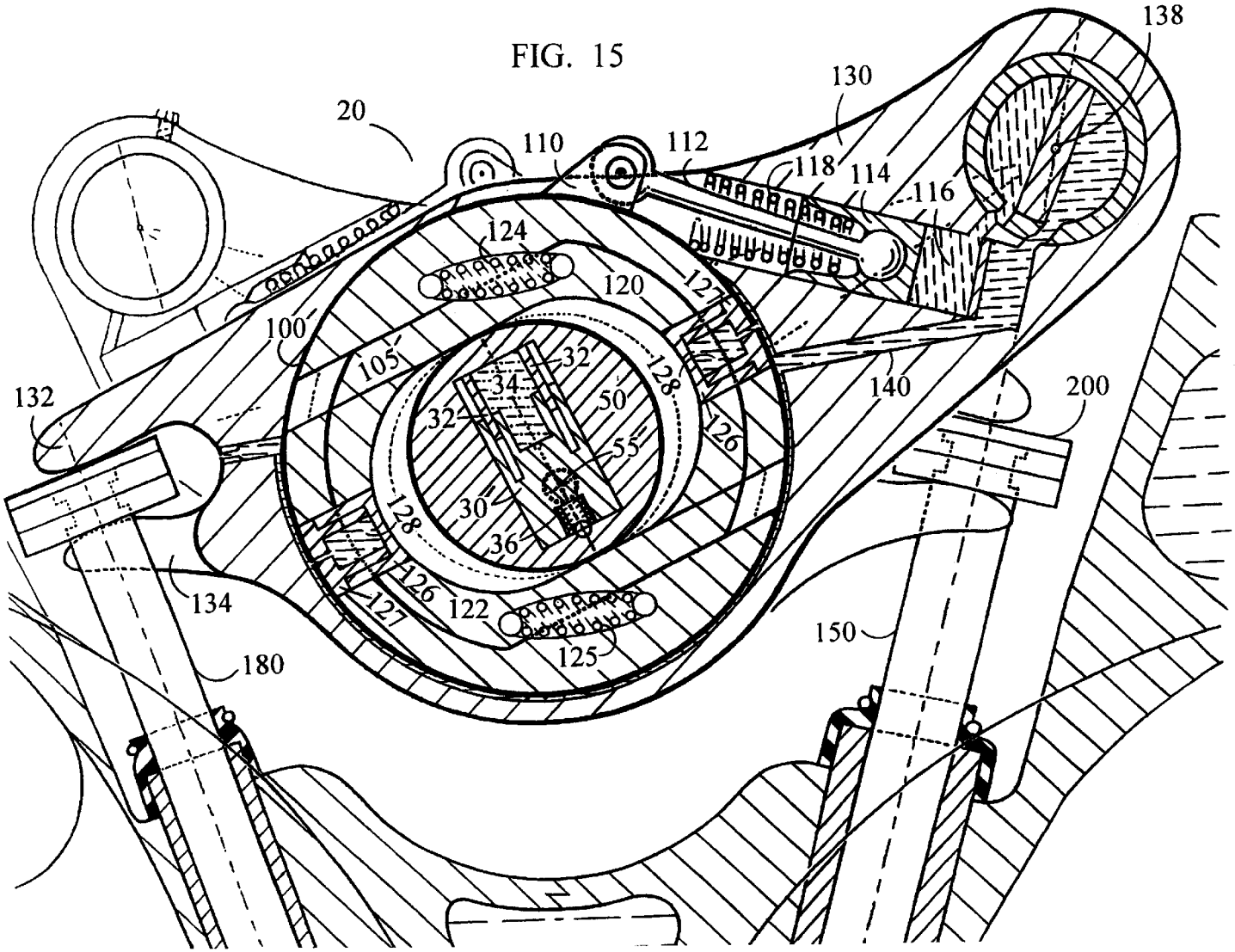
FIG. 15 illustrates an embodiment of the present invention having performance that is similar to the embodiment of FIG. 7, but in which the eccentricity of the camlobe and the major axis of the cam-follower are dynamically adjustable.

In another embodiment of the cam system of the current invention, the eccentricity of the camlobe and/or the major axis of the cam-follower may be dynamically adjusted during engine operation. FIG. 15 shows the cam system 20, but includes the mechanisms to adjust the eccentricity of the camlobe 50", the major axis of the cam-follower 100", and the rotational attitude of the cam-follower 100". This embodiment is designed to dynamically impact the amount of lift, valve timing, and valve open/closed duration events by varying the length of the cam-follower's major axis. This variation allows the amount of valve lift and the duration of the valve opening/closing events to be varied within a specified range. The ability to dynamically adjust both the multi-dimensional spatial and temporal aspects of valve actuation provides considerable benefits over conventional cam systems that have static lift, timing, and duration specifications.

Modification of the eccentric camlobe 50" and the ovoid cam-follower 100" involves the interdependent geometric dimensional changeability of the camlobe's rotational axis offset, and a synchronized and corresponding change of the long axis of the ovoid cam-follower 100". The interdependent dimensional equivalence between the long axis of the ovoid cam-follower 100" and the diameter of a circle described by the longest radius of the rotating eccentric camlobe 50" applies to this alternative form of the cam system. The dimensional interdependence can be expressed as follows: the cam follower's long axis measurement is nominally equal to the length of the longest of the radii of the eccentric camlobe multiplied by a factor of two (major axis=greatest radius×2). A change of critical dimensional measurement of either element must have an equivalent dimensional change of the other corresponding element.

This alternative embodiment allows the additional functional features of (1) dynamically adjustable gross cam/valve lift and (2) corresponding dynamically adjustable cam/valve opening/closing event duration. The dynamically adjustable lift feature occurs primarily by the effect achieved by the action of changing the offset axis 55 of eccentric camlobe 50. Starting at the rotational center point of the eccentric camlobe, having one fixed equal radius length through three hundred sixty degrees of rotation, will yield no gross or net deflection of the cam-follower along its short axis and so there is zero net lift. This occurs because all the radii in the eccentric cam mechanism are now equal; the cam-follower's long axis has the same measurement as the cam-follower's short axis. The short axis always has a functional measurement that is exactly the same as the diameter of the eccentric camlobe. Since the cam-follower now has equal axis length and the camlobe has equal radii length there is no lift and zero event duration.

One function of the dynamically adjustable cam-follower 100" is to effect the cam/valve opening and closing events' timing and duration. This alternative form retains the externally rotatable cam-follower feature that is primarily employed to determine the initiation and termination of the timing of the cam/valve opening and closing events. By adjusting and changing the long axis of the cam-follower 100", and thus the length ratio compared with the is fixed short axis length, the duration of the cam/valve opening and closing events can be varied within a specific range.

Referring to FIG. 15, the alternative embodiment of cam system 20 shown there has several differences from those embodiments previously discussed. The cam-follower 100" is now divided into three component parts: a first slidable interlocking segment 120, a second slidable interlocking segment 122, and an outer ring 124.

The first and second interlocking segments 120 and 122 provide adjustability of the duration of the valve opening or closing event. In the embodiment shown, first and second interlocking segments 120 and 122 are shaped like fish hooks (or the alphabet letter "J") in that each has a straight section that is blended into a half-round section. Segments 120 and 122 interlock nose-to-tail to create the ovoid form that comprises the inner circumference 105" of the cam-follower 100". As discussed above, the eccentric camlobe, here 50", traces itself upon the inner ovoid of the cam-follower. Embodiments are envisioned wherein more than two interlocking segments are conjoined to create the adjustable inner surface 105" of cam-follower 100". However, the two interlocking segments 120 and 122 are the preferred embodiment since increasing the number of interlocking components increases the complexity and potential for failure of the system.

The first and second segments 120 and 122 that comprise the ovoid form 105" are mounted within an outer ring 124.

Outer ring 124 functions as both a carrier and a guide for the first and second segments 120 and 122. The outer ring 124 controls the valve/cam event duration while being integrated or unified to form the adjustable cam-follower 100". Outer ring 124 also provides the limit and constraint on the adjustability of the first and second segments 120 and 122, and provides primary variable timing functions.

First and second interlocking and telescoping segments 120, 122 and outer ring 124 contain aligned and sealed hydraulic reservoirs 128. A first reservoir is defined within the half-round end of first interlocking portion 120 and outer ring 124, while a second opposing reservoir is defined within the half-round end of second interlocking portion 122 and outer ring 124. The reservoirs 128 receive hydraulic control fluid at suitable pressures through hydraulic fluid passage 140. The hydraulic reservoirs 128 are bounded by fixed wall 127 and slidable wall 126. These walls provide the sealing finction for reservoir 128. In addition, as hydraulic pressure increases within the reservoir 128 in response to additional control hydraulic fluid being pumped or driven into the reservoir, slidable wall 126 is forced inward relative to the camlobe 50", decreasing the length of the major axis of cam-follower 100". Conversely, as hydraulic pressure is decreased, slidable wall 126 is pushed outward relative to the camlobe 50", increasing the length of the major axis of cam-follower 100" which is returned by an individual spring against lower hydraulic pressure.

These events of increasing and decreasing the length of the cam-follower's major axis occur concurrently with changes to the eccentricity of camlobe 50". The eccentric camlobe 50" contains apparatus suitable to dynamically change the center of rotation 55" relative to the diameter of the camlobe 50". In the embodiment shown in FIG. 15 the camshaft is coupled to a camlobe drive mechanism 30". The camlobe drive mechanism 30" is slidably mounted within the camlobe 50" and guided by camlobe drive guides 32. The interface of the drive mechanism 30", the camlobe drive guides 32, and an inner wall of the camlobe 50" contain suitable seals to create a hydraulic reservoir 34. Reservoir 34 receives hydraulic control fluid at suitable pressures according to engine control conditions. As hydraulic pressure increases within reservoir 34, camlobe drive mechanism 30" is forced outward from a central position, moving axis of rotation 55" to a more eccentric position. Conversely, as hydraulic pressure is decreased, camlobe drive mechanism 30" is pushed inward towards a more central position by return spring 36.

In operation, as high pressure hydraulic control fluid is supplied to camlobe reservoir 34, increasing the eccentricity of rotational axis 55", low pressure in hydraulic fluid reservoirs 128 allows the interlocking segments 120 and 122 to spring expand, increasing the major axis of the cam-follower 100". By varying the eccentricity, the amount of vertical displacement (maximum lift) of the valves 150 and 180 can be varied. The embodiment shown in FIG. 15 utilizes a hydraulic actuation and spring biased return for the adjustment mechanism of both the offset of the axis of rotation 55" in camlobe 50" and the length of the major axis of the cam-follower 100". In other embodiments, either or both actuating devices may be both hydraulically actuated and returned. In addition, embodiments are envisioned wherein the actuating devices are pneumatic actuators, centrifugal apparatus, solenoids, or other electric or electro-mechanical actuating devices.

As with the previously discussed embodiments, the cam-follower 100" is rotatably mounted within the rocker assembly 130. Cam-follower 100" has a flange or pivot lever-type connection 110 coupled to a first end of transfer linkage 112, whose second end is coupled to the hydraulic piston 114. Hydraulic pressure within the cam-follower hydraulic cylinder 116 forces the piston 114 forward. Transfer linkage 112 translates the forward movement of the piston 114 into rotation of the cam-follower 100". The hydraulic piston 114 is provided with a spring 118 return, allowing the cam-follower 100" to counter-rotate when pressure is removed (though other return mechanisms can be used).

The position of cam-follower 100" is controlled through the actuator and transfer linkage by a controller that functions to initiate degrees of rotational variation from the fixed point 138 relative to the variable cam-follower 100". The control devices for cam-follower 100" may be simply actuated as a preset or manually adjusted mechanical controller mechanism; may be based on existing internal engine support systems such as the hydraulic bearing lubrication circuits (driven by the pressure supplied by the engine's oil pump) or the air pressures in the intake or exhaust tracts; may be electronically controlled based on one or more ASICs or microprocessors receiving data input from attendant engine parameter sensors; or may be controlled with a uniform system as discussed below.

The adjustability of the corresponding sympathetic unified movements of the rotational axial placement of eccentric camlobe 50" (length of its longest radius) as well as the consequent interlocking segments 120 and 122 placement in the multi-part ovoid inner-circumferential form of cam-follower 100" may be controlled mechanically, electrically, magnetically, electronically, centrifugally, hydraulically, or any combination of these or other motive forces. In the embodiment illustrated in FIG. 15 (for simplicity of example utilizing hydraulic control operation and spring returns) the hydraulic control circuit(s) regulate three interrelated discrete parameters manifested by (1) eccentric camlobe—lift, (2) interlocking segments (ovoid)—duration and (3) cam-follower—(variable) timing. Each component has secondary effects upon the primary function of the others.

The dynamic synthesis and synergy of purpose in effecting the overall performance and efficiency of the cam/valve train is controlled through the hydraulic control circuitry (or other motive forces) in response to engine load and performance envelope demand requirements. The engine dynamics can provide simplistic analogous criteria to direct the operation of the three is adjustable components under discussion, i.e., rpm or oil pressure fluctuation. The range of choices of mechanisms for operation may include any of the following: (1) a manual mechanical setting, (2) a sensitive pressure reactive hydraulic sleeve servo-piston, (3) a dynamo-driven electric servomotor, (4) a hybrid device(s) utilizing digital data derived from parameter sensors, (5) a full integration with contemporary state-of-the-art microprocessor(s) using comparative performance data, or (6) fully real-time reactive computer driven systems. Moreover, the cam system of the current invention may be fully integrated with the fuel injection and ignition timing systems to additionally optimize volumetric, combustion pressure, flame propagation, emissions, and scavenging efficiencies, as well as any turbo-supercharging components.

It should again be noted that although hydraulically actuated-spring return systems have been illustrated as the driving devices for the adjustability of the eccentric camlobe 50', the cam-follower interlocking segments 120 and 122, and the rotational attitude of cam-follower 100', this is merely for purposes of illustrating one embodiment. Centrifugal or pneumatic actuators, solenoids, or other electric or electromechanical devices or any combination of these may be used.

A Valve Embodiment Used with the Cam System

Figure 13:
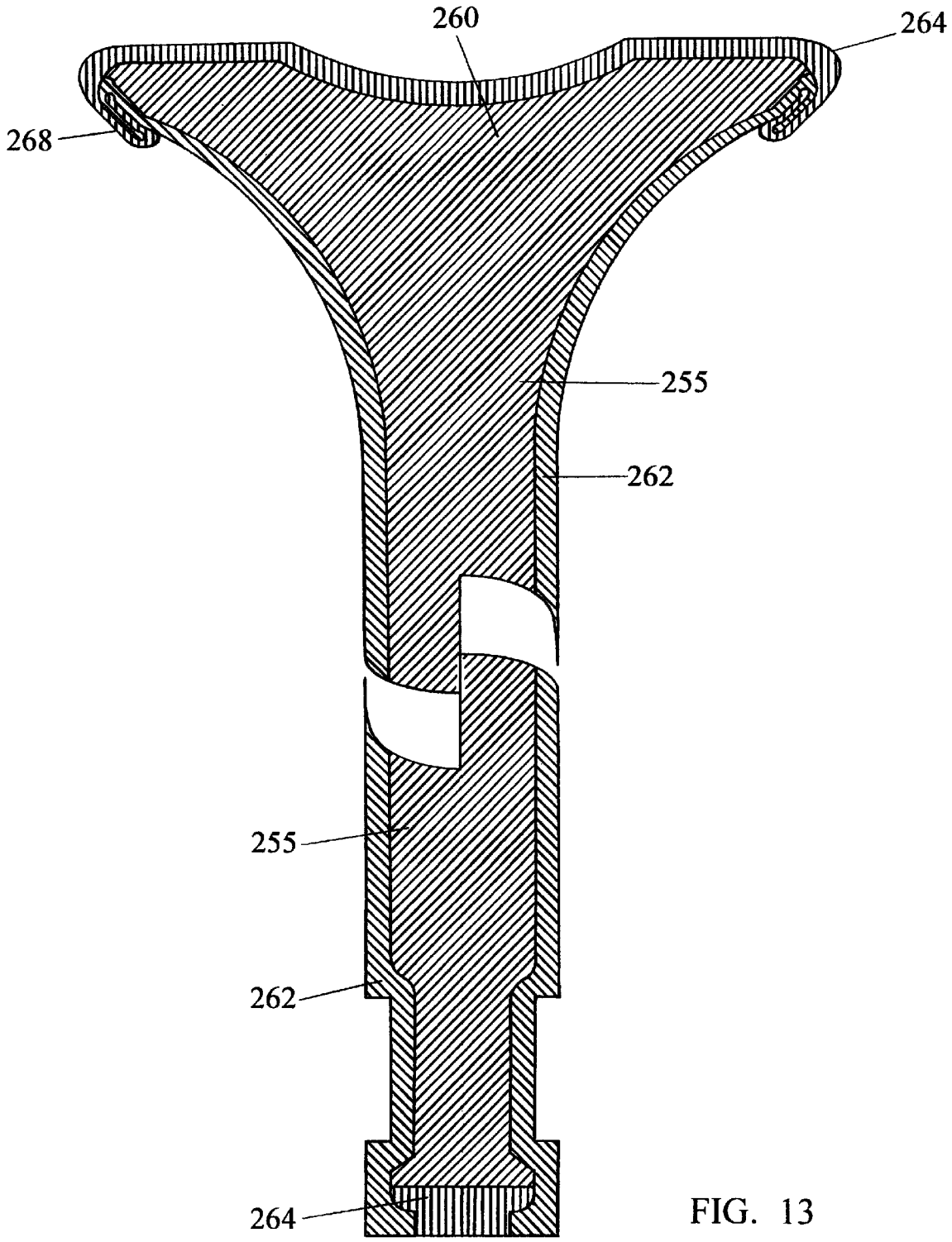
FIG. 13 is a cross-section of a sheathed valve which may be used with the current invention.

Reducing the weight of the components of cam system 20, and the friction of component interaction, lowers rotational inertias, and improves engine efficiency and rpm potential by reducing operational power consumption. In a low-weight preferred embodiment of the invention, the structural body of valves 150 and 180 is formed of titanium, and a thin section tubular high-tensile strength steel alloy is used to form the outer skin. This is illustrated in FIG. 13 where the valve 250, which may be either the intake or exhaust valve 150 or 180 of cam system 20, is made of an austenitic stainless steel tubular section 262 sheathing a titanium plug 255 which provides structural mass. This composite valve has low weight, low dynamic inertial mass, and strong resistance to heat and friction. It will be appreciated that various types of steel or steel alloys and/or other alloys may be applied as design considerations require. All of the surface area subject to the friction of the cam system will likely be formed of one of the various steel alloys.

Edges are formed at the valve head 260, where a cap piece 264 and the flared valve stem 262 are conjoining. A roll-sealed-edge joint 268 is preferably used to produce the resultant valve sealing face, which matches the angle of the valve seat. The edge joint of the valve face has four thicknesses of stainless steel, or other steel alloy. If a rocker arm assembly (such as that shown in FIG. 3 et al.) is used for connection of the valve 250 to cam system 20, the rocker arm assembly 130 may be formed from a combination of titanium body and steel alloy skin to reduce the weight of the system even further.

The Valve-rocker Arm Connection

Figure 14A:
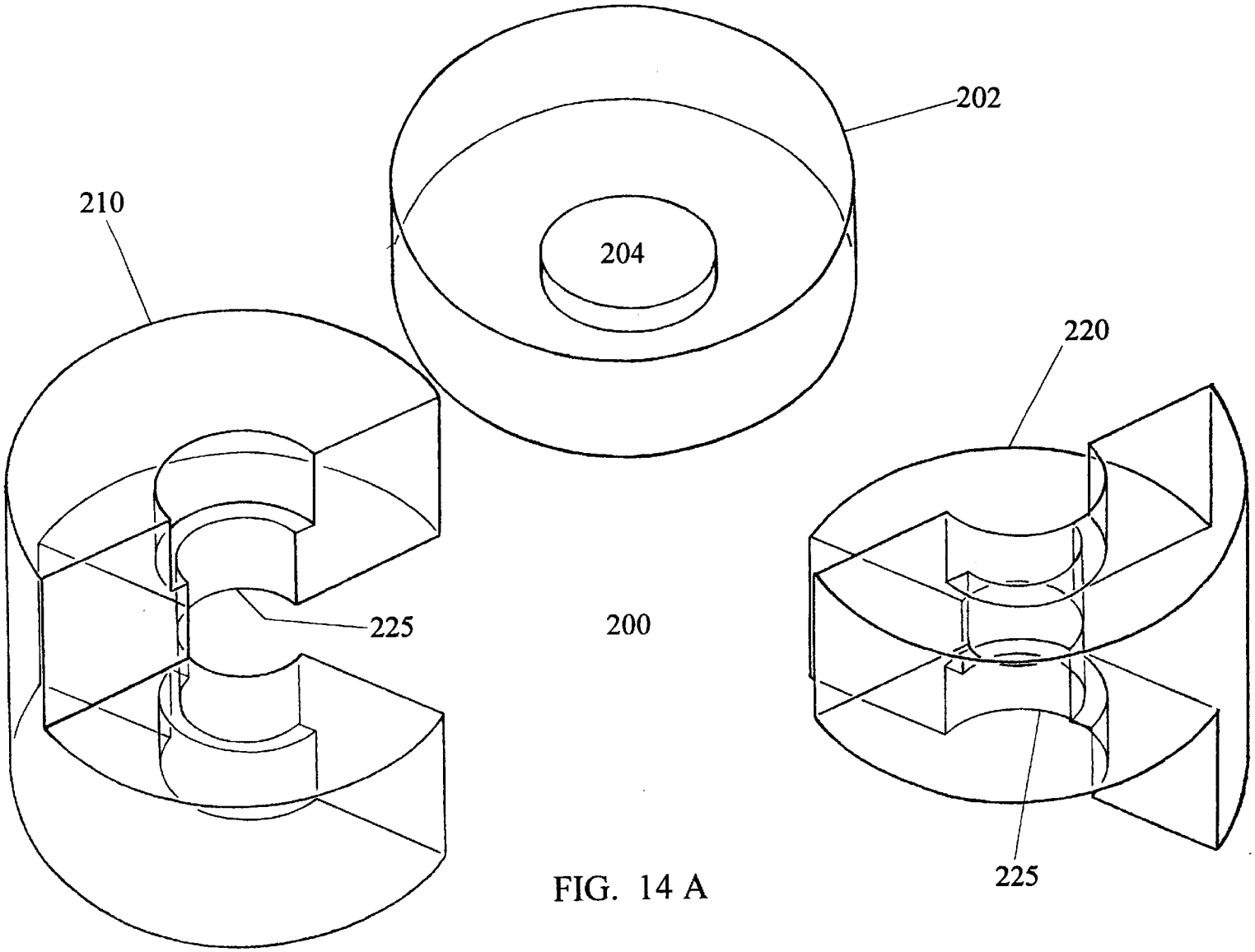
FIGS. 14A–14C are isometric, transparent exploded and assembled illustrations of a valve keeper which may be used with the cam system of the present invention.

Each of the valves 150 and 180 has a valve keeper 200. One embodiment of a valve keeper is shown in FIG. 14A. The valve keeper 200 includes a cap piece 202, a first interlocking half 210, and a second interlocking half 220. The cap piece 202 is formed into a disc shape with a thickness commensurate to provide the desired operating clearance for the upper and lower rocker arms 132 and 134. In general, it is found that the thickness of cap piece 202 varies between approximately 2 mm and approximately 2.5 mm.

On the underside of the cap piece 202, there is a depression 204 approximately the size of the diameter of valve stem 152 or 182 into which the valve stem tip 154 or 184 is fitted to provide a better coupling for the valve stem 152 or 182.

Figure 14B:
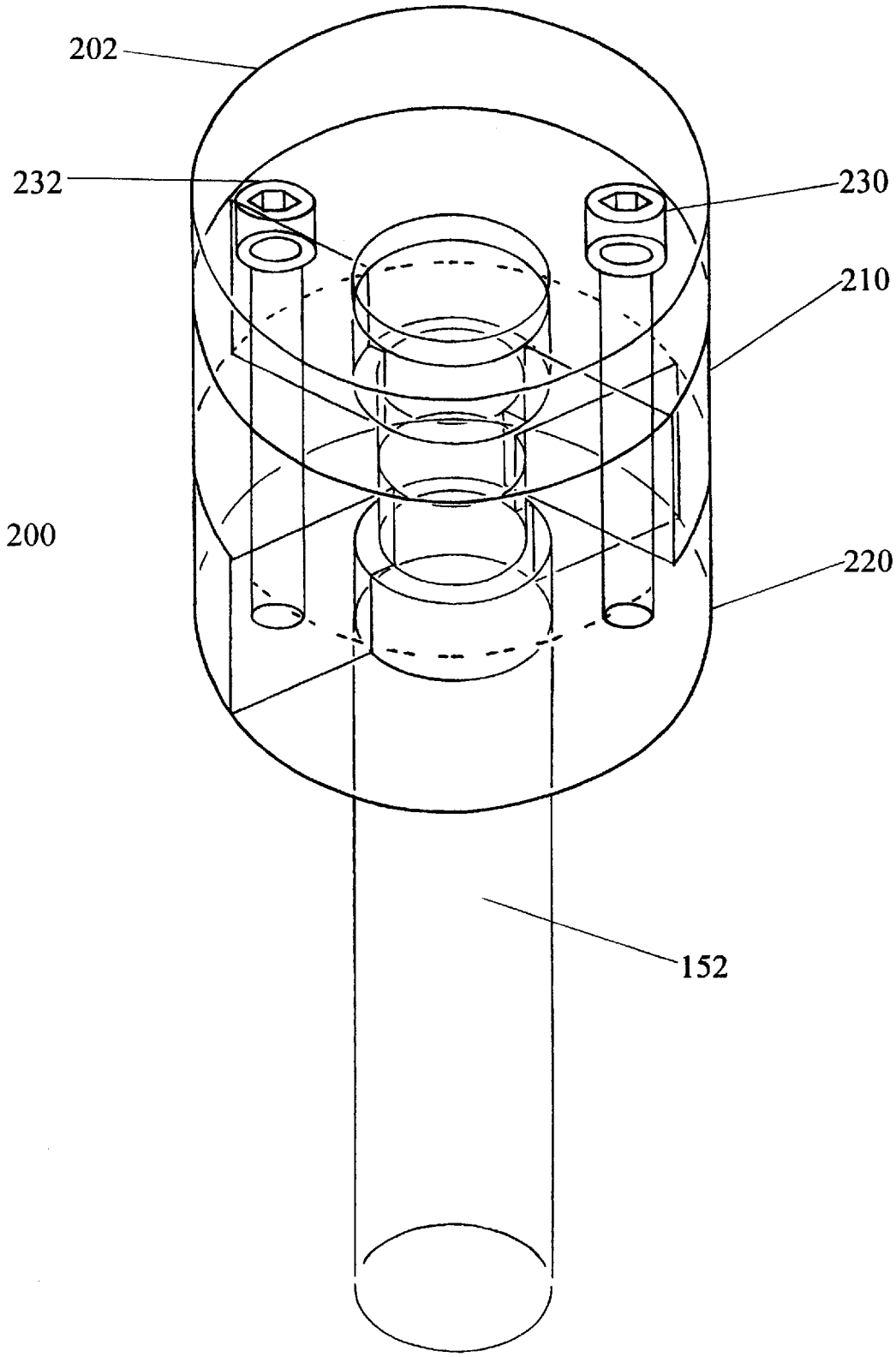

The two halves 210 and 220 are mirror images of each other and are based upon a ninety/one hundred eighty degree geometry. When assembled, the two halves 210 and 220 interlock and surround the valve stem 152 or 182 within keeper groove 225. The cap piece 202 is placed on top of the two interlocked keeper halves 210 and 220. As shown in FIG. 14B, two machine screws approximately 180 degrees apart are placed in threaded holes 230 and 232 which are bored through all three components. These machine screws, or other conventional fastening apparatus such as set screws or pins, provide structural fastening where the two keeper halves 210 and 220 interlock, vertically fastening all three keeper components into one unified device as shown in FIG. 14B.

Figure 14C:
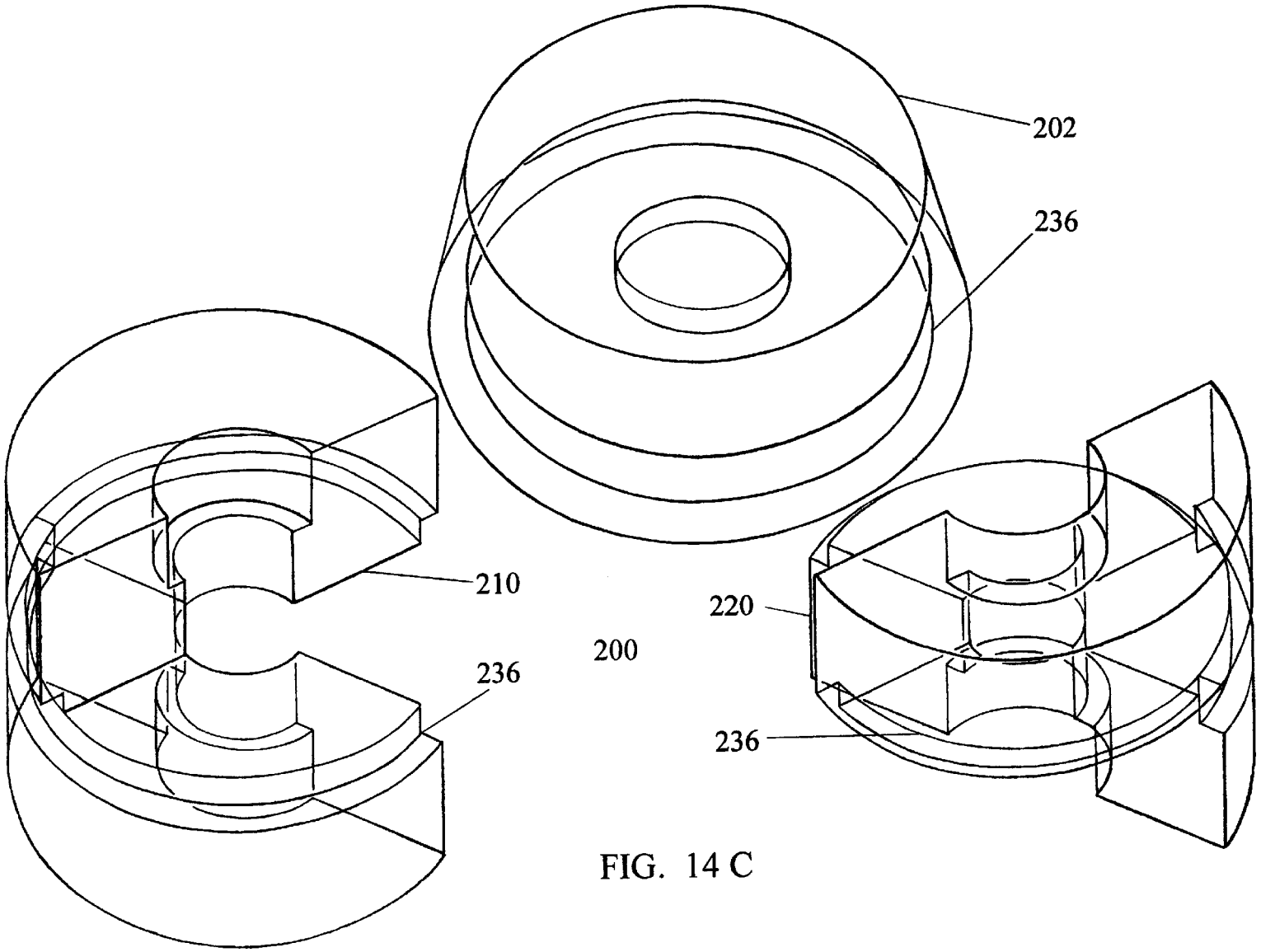

In an alternative form, the three valve keeper components are fastened together by a spring steel cir-clip ring or any other conventional form of ring fastener placed in a continuous groove around the outside circumference of the assembled halves 210 and 220, and the cap piece 202 (see FIG. 14C). Cap piece 202 is similar to a bottlecap—its sides hold the interlocking pieces 210 and 220 as a cir-clip would.

In another alternative embodiment of the valve keeper 200, the sections of the valve keeper are three instead of two, based upon a sixty/one hundred twenty degree geometry in which the valve keeper is divided into thirds with sixty degree joining sections. Three machine screws, or other fasteners as discussed above, fasten through the overlapping segments to form one keeper unit with a cap piece on top of the segments.

In all of these variations, the valve keeper 200 functions essentially the same—firmly attaching to the valve stem tip 154 or 184 so that the valve 150 or 180 can be positively opened and closed by the rocker arm assembly 130 providing considerable improvement over conventional valve keepers. This valve keeper improved geometry is especially useful in the positive open and close valve assemblies common to desmodromic engines.

It will be appreciated by those of ordinary skill in the art having the benefit of this disclosure that numerous variations from the foregoing illustrations will be possible without departing from the inventive concept described herein. Accordingly, it is the claims set forth below, and not merely the foregoing illustrations, which are intended to define the exclusive rights of the invention. In addition, the above description and the following claims are directed in some instances to single elements of the invention such as single valves, cylinders, cams, etc. This approach has been taken in the interest of simplification and clarity, and with recognition that the invention is not limited to such single elements. More complex embodiments of the invention involving multiple such elements are effectively multiple versions of the single elements and are intended to be embraced by such description and claims.

What is claimed is:

1. A valve comprising:

a) a body comprising a first material of titanium, the body having a stem portion and a valve head at a first end of the stem portion;

b) a skin covering at least a portion of the body, the skin comprising a second material of high tensile strength steel.

2. The valve of claim 1 further comprising a cap comprised of a third material covenng at least a portion of the valve head.

3. The valve of claim 1 wherein the high tensile strength steel is austenitic stainless steel.

4. A valve comprising:

a) an internal plug comprising titanium with first and second ends, the first end comprising a stem and the second end flaring into a head;

b) a tubular section comprised of a steel alloy sheathing the internal plug.

* * * * *